US011814832B2

(12) United States Patent
Pilarczyk

(10) Patent No.: US 11,814,832 B2
(45) Date of Patent: Nov. 14, 2023

(54) OVERFLOW COVERS AND OVERFLOW SYSTEMS FOR BATHTUBS

(71) Applicant: WCM Industries, Inc., Colorado Springs, CO (US)

(72) Inventor: Eric Pilarczyk, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 252 days.

(21) Appl. No.: 17/197,583

(22) Filed: Mar. 10, 2021

(65) Prior Publication Data

US 2021/0285195 A1 Sep. 16, 2021

Related U.S. Application Data

(60) Provisional application No. 62/989,222, filed on Mar. 13, 2020.

(51) Int. Cl.
*E03C 1/244* (2006.01)

(52) U.S. Cl.
CPC ..... *E03C 1/244* (2013.01)

(58) Field of Classification Search
CPC ..... E03C 1/244
USPC ..... 4/679, 680, 694
See application file for complete search history.

(56) References Cited

U.S. PATENT DOCUMENTS

| | | | |
|---|---|---|---|
| 37,956 | A | 3/1863 | Dyott |
| 156,971 | A | 11/1874 | Beins et al. |
| 427,478 | A | 5/1890 | McEvoy |
| 437,289 | A | 9/1890 | Clark |
| 569,247 | A | 10/1896 | Smith |
| 608,207 | A | 8/1898 | Merritt |
| 775,020 | A | 11/1904 | Waterman |
| 820,437 | A | 5/1906 | Pehrson |
| 843,968 | A | 2/1907 | Sharp, Jr. |

(Continued)

FOREIGN PATENT DOCUMENTS

| | | |
|---|---|---|
| CA | 530215 | 9/1956 |
| CH | 346187 | 6/1960 |

(Continued)

OTHER PUBLICATIONS

"AB&A Catalog," American Brass & Aluminum Foundry, Inc., Sep. 1, 1995, 28 pages.

(Continued)

*Primary Examiner* — Tuan N Nguyen

(57) ABSTRACT

An overflow system for concealing an overflow conduit of a bathtub includes a nut and a cover. The nut has an inner mount configured to secure to the conduit that is substantially circular in shape, and an outer mount including a plurality of engagement sections that extend substantially tangential to the inner mount. The inner mount has a thickness that is greater than a thickness of the outer mount, and the outer mount is centered on and integral with the inner mount. The cover is configured to couple to the nut and is substantially square. The cover includes a front wall and a plurality of side walls, each having a first end extending from the front wall and an opposite second end. The second end includes a lip configured to engage with a respective engagement section of the plurality of engagement sections when the cover is coupled to the nut.

19 Claims, 8 Drawing Sheets

(56) References Cited

U.S. PATENT DOCUMENTS

| | | | |
|---|---|---|---|
| 880,939 | A | 3/1908 | Virgo |
| 917,717 | A | 4/1909 | Diedrick |
| 938,102 | A | 10/1909 | Wise |
| 952,240 | A | 3/1910 | Deming |
| 964,954 | A | 7/1910 | Coles |
| 1,013,175 | A | 1/1912 | Jones |
| 1,018,021 | A | 2/1912 | Willetts |
| 1,068,039 | A | 7/1913 | Clark |
| 1,173,710 | A | 2/1916 | Crocker et al. |
| 1,173,854 | A | 2/1916 | Pearch |
| 1,213,466 | A | 1/1917 | Delanoy et al. |
| 1,330,909 | A | 2/1920 | Sharp, Jr. |
| 1,331,018 | A | 2/1920 | Luthy |
| 1,371,715 | A | 3/1921 | West |
| 1,518,599 | A | 12/1924 | Murray |
| 1,528,081 | A | 3/1925 | Schermerhorn et al. |
| 1,573,820 | A | 2/1926 | Gade |
| 1,645,027 | A | 10/1927 | Scott |
| 1,669,473 | A | 5/1928 | Kelso |
| 1,692,710 | A | 11/1928 | Spahn |
| 1,712,704 | A | 5/1929 | Kiser |
| 1,760,704 | A | 5/1930 | Lindstrom |
| 1,781,719 | A | 11/1930 | Darling |
| 1,788,083 | A | 1/1931 | Church |
| 1,805,816 | A | 5/1931 | Fleming |
| 1,873,274 | A | 8/1932 | Boosey |
| 1,893,979 | A | 1/1933 | Barrere |
| 1,923,482 | A | 8/1933 | Frankenstein |
| 1,925,008 | A | 8/1933 | Schacht |
| 1,977,177 | A | 10/1934 | De Flores |
| 1,980,493 | A | 11/1934 | Morrisseau |
| 2,016,498 | A | 10/1935 | Hopewell |
| 2,036,614 | A | 4/1936 | Tharp |
| 2,044,253 | A | 6/1936 | Morris |
| 2,045,731 | A | 6/1936 | Solari |
| 2,045,732 | A | 6/1936 | Solari |
| 2,059,532 | A | 11/1936 | Nagel |
| 2,061,553 | A | 11/1936 | Acosta |
| 2,062,145 | A | 11/1936 | Pickop |
| 2,084,437 | A | 6/1937 | Frankenberger |
| 2,096,651 | A | 10/1937 | Romeo |
| 2,150,483 | A | 3/1939 | Bentz |
| 2,190,532 | A | 2/1940 | Lukonski |
| 2,193,527 | A | 3/1940 | Bentz |
| 2,197,716 | A | 4/1940 | Whitaker |
| 2,222,807 | A | 11/1940 | Burr |
| 2,223,365 | A | 12/1940 | Groeniger |
| 2,278,566 | A | 4/1942 | Schaible |
| 2,323,224 | A | 6/1943 | Kuhnle |
| 2,374,815 | A | 5/1945 | Haas, Jr. |
| 2,444,340 | A | 6/1948 | Donahue |
| 2,462,752 | A | 2/1949 | Kotches |
| 2,528,919 | A | 11/1950 | Stone et al. |
| 2,570,546 | A | 10/1951 | Hamlett |
| 2,580,575 | A | 1/1952 | Muckler |
| 2,664,142 | A | 12/1953 | Scheuerman et al. |
| 2,670,029 | A | 2/1954 | Rossi |
| 2,736,577 | A | 2/1956 | Mackey |
| 2,832,081 | A | 4/1958 | Young |
| 2,890,463 | A | 6/1959 | Young |
| 2,905,951 | A | 9/1959 | Weddendorf, Jr. |
| 2,915,903 | A | 12/1959 | Digby et al. |
| 2,965,153 | A | 12/1960 | Purcell, Sr. |
| 2,966,311 | A | 12/1960 | Davis |
| 2,976,543 | A | 3/1961 | Turner et al. |
| 2,992,437 | A | 7/1961 | Nelson et al. |
| 2,993,655 | A | 7/1961 | O'Brien |
| RE25,175 | E | 5/1962 | Nelson et al. |
| 3,037,212 | A | 6/1962 | Kleinhof |
| 3,046,028 | A | 7/1962 | Nathan |
| 3,048,415 | A | 8/1962 | Shook |
| 3,082,432 | A | 3/1963 | Pearlman |
| 3,096,527 | A | 7/1963 | Eynon |
| 3,121,879 | A | 2/1964 | Young |
| 3,263,244 | A | 8/1966 | Katz |
| 3,311,391 | A | 3/1967 | Harrell |
| 3,316,562 | A | 5/1967 | Van Dyke et al. |
| 3,345,085 | A | 10/1967 | Hanes |
| 3,349,412 | A | 10/1967 | Schwartz et al. |
| 3,380,081 | A | 4/1968 | Eilertson et al. |
| 3,416,982 | A | 12/1968 | Petzetakis |
| 3,493,978 | A | 2/1970 | Hindman et al. |
| 3,501,172 | A | 3/1970 | Pickard |
| 3,528,112 | A | 9/1970 | Warnick |
| 3,579,670 | A | 5/1971 | Frank |
| 3,608,098 | A | 9/1971 | Andrisani |
| 3,615,984 | A | 10/1971 | Chase |
| 3,684,199 | A | 8/1972 | Bebinger |
| 3,724,507 | A | 4/1973 | Kleykamp et al. |
| 3,742,525 | A | 7/1973 | Oropallo |
| 3,800,339 | A | 4/1974 | Bergin |
| 3,813,708 | A | 6/1974 | Hamburg |
| 3,860,977 | A | 1/1975 | Politz |
| 3,881,201 | A | 5/1975 | Richards |
| 3,911,635 | A | 10/1975 | Traupe |
| 3,937,497 | A | 2/1976 | Studer |
| 3,982,289 | A | 9/1976 | Robbins |
| 4,059,289 | A | 11/1977 | Morris et al. |
| 4,087,127 | A | 5/1978 | Lotta |
| D248,133 | S | 6/1978 | Shames et al. |
| 4,092,745 | A | 6/1978 | Oropallo |
| 4,123,810 | A | 11/1978 | Oropallo |
| 4,127,904 | A | 12/1978 | Junker |
| 4,135,258 | A | 1/1979 | Braga et al. |
| 4,146,939 | A | 4/1979 | Izzi |
| 4,194,251 | A | 3/1980 | Pennerstorfer |
| 4,207,632 | A | 6/1980 | Savell, Jr. et al. |
| 4,232,407 | A | 11/1980 | Williams |
| 4,233,697 | A | 11/1980 | Cornwall |
| 4,238,860 | A | 12/1980 | Dixon |
| 4,240,166 | A | 12/1980 | Altman et al. |
| 4,257,892 | A | 3/1981 | Boersma |
| 4,294,370 | A | 10/1981 | Toeppen |
| 4,307,901 | A | 12/1981 | Orberg et al. |
| 4,310,933 | A | 1/1982 | Stratman |
| 4,320,540 | A | 3/1982 | Leavens |
| 4,329,744 | A | 5/1982 | Cuschera |
| 4,352,213 | A | 10/1982 | Watts |
| 4,359,788 | A | 11/1982 | Liou |
| 4,359,790 | A | 11/1982 | Chalberg |
| 4,371,991 | A | 2/1983 | Schrott |
| 4,387,914 | A | 6/1983 | Paulson et al. |
| 4,412,361 | A | 11/1983 | Cuschera |
| 4,413,384 | A | 11/1983 | Lassche |
| 4,457,030 | A | 7/1984 | Burry |
| 4,470,437 | A | 9/1984 | Rabinovich |
| 4,475,256 | A | 10/1984 | Hatala |
| 4,502,166 | A | 3/1985 | Brown, Sr. |
| 4,505,499 | A | 3/1985 | Uglow et al. |
| 4,520,515 | A | 6/1985 | Hatala |
| 4,542,642 | A | 9/1985 | Tagliarino |
| 4,553,625 | A | 11/1985 | Tsuge et al. |
| 4,571,751 | A | 2/1986 | Barlow |
| 4,574,402 | A | 3/1986 | Brown, Sr. |
| 4,574,409 | A | 3/1986 | McAffrey |
| 4,594,738 | A | 6/1986 | Gebert |
| 4,594,740 | A | 6/1986 | Tseronakis |
| 4,599,784 | A | 7/1986 | Canu, Jr. et al. |
| 4,660,860 | A | 4/1987 | Todd |
| 4,683,597 | A | 8/1987 | Taylor et al. |
| 4,692,948 | A | 9/1987 | Martin |
| 4,706,306 | A | 11/1987 | Smith |
| 4,706,482 | A | 11/1987 | Barber |
| 4,720,877 | A | 1/1988 | Watts |
| 4,722,556 | A | 2/1988 | Todd |
| 4,730,855 | A | 3/1988 | Pelletier |
| D296,816 | S | 7/1988 | Budzinski et al. |
| 4,763,510 | A | 8/1988 | Palmer |
| 4,796,926 | A | 1/1989 | Rapsilver |
| 4,799,713 | A | 1/1989 | Uglow et al. |
| 4,813,745 | A | 3/1989 | Woody |
| 4,825,477 | A | 5/1989 | Aranda |
| 4,850,617 | A | 7/1989 | Moberly |
| 4,865,353 | A | 9/1989 | Osborne |

(56) References Cited

U.S. PATENT DOCUMENTS

| | | | |
|---|---|---|---|
| 4,890,967 | A | 1/1990 | Rosenbaum |
| 4,920,582 | A | 5/1990 | Alker |
| 4,936,350 | A | 6/1990 | Huber |
| 4,945,579 | A | 8/1990 | Husting |
| 4,953,235 | A | 9/1990 | Cornwall |
| 5,025,509 | A | 6/1991 | Holt et al. |
| 5,076,095 | A | 12/1991 | Erhardt |
| 5,115,554 | A | 5/1992 | Fell, Sr. |
| 5,123,123 | A | 6/1992 | Hart et al. |
| 5,163,480 | A | 11/1992 | Huber |
| 5,165,118 | A | 11/1992 | Cendrowski |
| 5,228,153 | A | 7/1993 | Frankel |
| D341,410 | S | 11/1993 | Molinaro |
| 5,257,648 | A | 11/1993 | Oropallo |
| 5,265,281 | A | 11/1993 | McAlpine |
| 5,267,474 | A | 12/1993 | Ten Hoven |
| 5,271,108 | A | 12/1993 | Wicke |
| 5,273,077 | A | 12/1993 | Oropallo |
| 5,291,619 | A | 3/1994 | Adorjan |
| 5,295,760 | A | 3/1994 | Rowe |
| 5,297,817 | A | 3/1994 | Hodges |
| 5,318,230 | A | 6/1994 | Ferguson et al. |
| 5,324,001 | A | 6/1994 | Duke |
| 5,330,811 | A | 7/1994 | Buchalter |
| 5,350,266 | A | 9/1994 | Espey et al. |
| 5,351,996 | A | 10/1994 | Martin |
| 5,363,519 | A | 11/1994 | Husting |
| 5,369,815 | A | 12/1994 | Martin |
| 5,372,715 | A | 12/1994 | Maggard et al. |
| 5,376,264 | A | 12/1994 | Betancourt |
| 5,377,361 | A | 1/1995 | Piskula |
| 5,417,460 | A | 5/1995 | Lunder |
| 5,418,983 | A | 5/1995 | Garguillo et al. |
| 5,442,819 | A | 8/1995 | Penor et al. |
| 5,495,750 | A | 3/1996 | Dufresne |
| 5,497,514 | A | 3/1996 | Miller |
| 5,497,516 | A | 3/1996 | Irwin |
| 5,507,501 | A | 4/1996 | Palmer |
| 5,509,148 | A | 4/1996 | Steele et al. |
| 5,535,455 | A | 7/1996 | Liu |
| D373,623 | S | 9/1996 | Mathison |
| 5,560,052 | A | 10/1996 | Ferguson et al. |
| 5,581,018 | A | 12/1996 | Allen et al. |
| 5,590,916 | A | 1/1997 | Liu |
| D381,405 | S | 7/1997 | Waidele et al. |
| 5,661,462 | A | 8/1997 | Shrewsbury-Gee |
| 5,682,620 | A | 11/1997 | Stoltz et al. |
| 5,692,248 | A | 12/1997 | Ball |
| 5,740,830 | A | 4/1998 | Mankins |
| 5,745,931 | A | 5/1998 | Ball |
| 5,758,368 | A | 6/1998 | Ball |
| 5,786,054 | A | 7/1998 | Platusich et al. |
| 5,799,986 | A | 9/1998 | Corbett et al. |
| 5,815,895 | A | 10/1998 | Carlson et al. |
| 5,819,328 | A | 10/1998 | Lewis |
| 5,881,397 | A | 3/1999 | Hobbs |
| 5,890,241 | A | 4/1999 | Ball |
| 5,924,635 | A | 7/1999 | Koshimizu et al. |
| 5,931,184 | A | 8/1999 | Armenia et al. |
| 5,937,450 | A | 8/1999 | Jones |
| 5,944,985 | A | 8/1999 | Bowman |
| 5,957,514 | A | 9/1999 | Brookshire |
| 5,971,438 | A | 10/1999 | Johnson |
| 5,997,049 | A | 12/1999 | Kingsford et al. |
| 6,058,525 | A | 5/2000 | Paden |
| 6,058,526 | A | 5/2000 | Parisi et al. |
| 6,062,254 | A | 5/2000 | Brady et al. |
| 6,066,119 | A | 5/2000 | Ball |
| 6,067,669 | A | 5/2000 | Peterson et al. |
| 6,070,910 | A | 6/2000 | Hodges |
| 6,073,278 | A | 6/2000 | Ball |
| 6,076,545 | A | 6/2000 | Cooper |
| D428,133 | S | 7/2000 | Chen |
| 6,085,362 | A | 7/2000 | Huber |
| 6,085,363 | A | 7/2000 | Huber |
| 6,088,843 | A | 7/2000 | Francisco |
| 6,098,212 | A | 8/2000 | Rogan |
| 6,105,183 | A | 8/2000 | Bly |
| 6,108,828 | A | 8/2000 | Cheng |
| 6,126,233 | A | 10/2000 | Gaetano et al. |
| 6,138,290 | A | 10/2000 | Lin |
| 6,138,298 | A | 10/2000 | Ball |
| 6,145,136 | A | 11/2000 | Parisi et al. |
| 6,148,454 | A | 11/2000 | Ball |
| 6,154,898 | A | 12/2000 | Ball |
| 6,158,809 | A | 12/2000 | Gobbers et al. |
| 6,173,459 | B1 | 1/2001 | Ball |
| 6,185,755 | B1 | 2/2001 | Shepherd et al. |
| 6,192,531 | B1 | 2/2001 | Fritz et al. |
| 6,193,879 | B1 | 2/2001 | Bowman |
| 6,195,819 | B1 | 3/2001 | Wang |
| 6,205,594 | B1 | 3/2001 | Solaberry |
| 6,216,288 | B1 | 4/2001 | Bernau |
| 6,226,806 | B1 | 5/2001 | Ball |
| 6,263,518 | B1 | 7/2001 | Magtanong |
| 6,269,495 | B1 | 8/2001 | Sondrup |
| 6,272,699 | B1 | 8/2001 | Peterson |
| 6,289,532 | B1 | 9/2001 | Fritz et al. |
| 6,295,659 | B1 | 10/2001 | Sandness |
| 6,295,664 | B2 | 10/2001 | Fritz et al. |
| 6,317,906 | B1 | 11/2001 | Ball |
| 6,332,632 | B1 | 12/2001 | Hodges |
| 6,338,168 | B1 | 1/2002 | Valentine |
| 6,362,734 | B1 | 3/2002 | McQuade et al. |
| 6,378,912 | B1 | 4/2002 | Condon et al. |
| 6,418,570 | B1 | 7/2002 | Ball |
| 6,448,907 | B1 | 9/2002 | Naclerio |
| 6,484,331 | B2 | 11/2002 | Minnick |
| 6,490,739 | B1 | 12/2002 | Lee |
| 6,508,490 | B1 | 1/2003 | Hoffman |
| 6,510,860 | B2 | 1/2003 | Kihs |
| 6,530,722 | B1 | 3/2003 | Shaw et al. |
| 6,546,573 | B1 | 4/2003 | Ball |
| 6,592,669 | B2 | 7/2003 | Damrau |
| 6,606,753 | B2 | 8/2003 | Minnick |
| 6,618,875 | B1 | 9/2003 | Oropallo et al. |
| 6,622,317 | B1 | 9/2003 | Oropallo et al. |
| 6,631,623 | B1 | 10/2003 | Ball |
| 6,637,050 | B1 | 10/2003 | Ball |
| 6,640,358 | B2 | 11/2003 | Ball |
| 6,675,406 | B2 | 1/2004 | Ball |
| 6,675,407 | B1 | 1/2004 | Ball |
| 6,681,420 | B1 | 1/2004 | Ball |
| 6,687,926 | B1 | 2/2004 | Bayley |
| 6,691,411 | B2 | 2/2004 | Ball |
| 6,696,943 | B1 | 2/2004 | Elrod et al. |
| 6,719,294 | B2 | 4/2004 | Nguyen et al. |
| 6,735,791 | B1 | 5/2004 | Lordahl et al. |
| 6,789,275 | B2 | 9/2004 | Spells, Sr. et al. |
| 6,795,987 | B2 | 9/2004 | Cornwall |
| 6,799,606 | B1 | 10/2004 | Howson |
| 6,800,024 | B1 | 10/2004 | Prevost |
| 6,812,844 | B1 | 11/2004 | Burgess |
| 6,823,540 | B2 | 11/2004 | Gunn |
| 6,836,911 | B2 | 1/2005 | Minnick |
| 6,880,179 | B2 | 4/2005 | Wang |
| 6,895,838 | B2 | 5/2005 | Stahnke |
| 6,901,611 | B2 | 6/2005 | McEntire et al. |
| 6,953,049 | B2 | 10/2005 | Kowalke |
| D517,666 | S | 3/2006 | Wilk, Jr. et al. |
| 7,013,500 | B1 | 3/2006 | Lin |
| 7,017,199 | B2 | 3/2006 | Oropallo et al. |
| D523,123 | S | 6/2006 | Wilk, Jr. et al. |
| 7,055,184 | B2 | 6/2006 | Humber |
| 7,096,522 | B2 | 8/2006 | Hirtriter |
| 7,127,752 | B2 | 10/2006 | Ball |
| 7,185,529 | B2 | 3/2007 | Ball |
| 7,188,376 | B2 | 3/2007 | Ortiz et al. |
| 7,210,493 | B1 | 5/2007 | Wang |
| 7,237,280 | B1 | 7/2007 | Holden, Jr. et al. |
| D549,805 | S | 8/2007 | Quach |
| 7,300,074 | B1 | 11/2007 | Paulson |
| 7,328,953 | B2 | 2/2008 | Werschmidt |
| 7,341,286 | B2 | 3/2008 | Andre |

(56) References Cited

U.S. PATENT DOCUMENTS

| | | | |
|---|---|---|---|
| 7,343,923 | B2 | 3/2008 | Foster |
| 7,451,502 | B2 | 11/2008 | Ball |
| D586,433 | S | 2/2009 | Price et al. |
| 7,503,083 | B2 | 3/2009 | Ball |
| 7,506,385 | B2 | 3/2009 | Werschmidt |
| 7,549,702 | B2 | 6/2009 | Meyers |
| D599,447 | S | 9/2009 | Cummings et al. |
| 7,740,197 | B1 | 6/2010 | Schulz |
| 7,774,871 | B1 | 8/2010 | Arsenault |
| 7,814,580 | B2 | 10/2010 | Coronado et al. |
| D627,862 | S | 11/2010 | Ball |
| D627,863 | S | 11/2010 | Ball |
| 7,856,677 | B1 | 12/2010 | Harris |
| D636,468 | S | 4/2011 | Ball |
| D637,696 | S | 5/2011 | Ball et al. |
| 7,963,568 | B2 | 6/2011 | Jensen |
| 8,028,357 | B2 | 10/2011 | Ball |
| D652,122 | S | 1/2012 | Bonhag et al. |
| D659,809 | S | 5/2012 | Smith |
| 8,166,584 | B2 | 5/2012 | Ball |
| D665,062 | S | 8/2012 | Ball |
| 8,266,735 | B2 | 9/2012 | McLeod |
| 8,302,220 | B2 | 11/2012 | Ball |
| 8,321,970 | B2 | 12/2012 | Ball |
| D674,883 | S | 1/2013 | Ball |
| 8,347,906 | B1 | 1/2013 | Ismert et al. |
| 8,505,132 | B2 | 8/2013 | Ball |
| 8,584,272 | B2 | 11/2013 | Ball |
| 8,607,376 | B2 | 12/2013 | Ball |
| D705,402 | S | 5/2014 | Yu |
| 8,756,724 | B1 | 6/2014 | Lordahl et al. |
| 8,769,736 | B2 | 7/2014 | Ball |
| 8,925,123 | B2 | 1/2015 | DeGooyer et al. |
| 9,015,870 | B2 | 4/2015 | Ball |
| 9,015,876 | B2 | 4/2015 | Ball |
| D729,257 | S | 5/2015 | Ball |
| 9,045,886 | B2 | 6/2015 | Ball |
| 9,074,358 | B2 | 7/2015 | Ball et al. |
| 9,157,220 | B2 | 10/2015 | Ball |
| 9,200,436 | B2 | 12/2015 | Ball |
| 9,267,274 | B2 | 2/2016 | Ball |
| 9,663,930 | B2 | 5/2017 | Ball |
| 10,017,925 | B1 | 7/2018 | Kuo |
| 10,329,752 | B2 | 6/2019 | Ball |
| 10,443,220 | B2 | 10/2019 | Ball et al. |
| 10,544,572 | B2 | 1/2020 | Humber |
| 10,563,385 | B1 | 2/2020 | Ball |
| 2001/0002494 | A1 | 6/2001 | Fritz et al. |
| 2002/0023294 | A1 | 2/2002 | Spells, Sr. |
| 2002/0032926 | A1 | 3/2002 | Lewis |
| 2002/0112285 | A1 | 8/2002 | Minnick |
| 2002/0121982 | A1 | 9/2002 | Ferris et al. |
| 2003/0000012 | A1 | 1/2003 | Ball |
| 2003/0024568 | A1 | 2/2003 | Bowman |
| 2003/0025275 | A1 | 2/2003 | Miller |
| 2003/0051343 | A1 | 3/2003 | Ball |
| 2003/0151281 | A1 | 8/2003 | Williams |
| 2003/0182721 | A1 | 10/2003 | Li |
| 2003/0192115 | A1 | 10/2003 | Oropallo et al. |
| 2004/0012197 | A1 | 1/2004 | Guillaud et al. |
| 2004/0034926 | A1 | 2/2004 | Ball |
| 2004/0055083 | A1 | 3/2004 | Ball |
| 2004/0055084 | A1 | 3/2004 | Ball |
| 2004/0068792 | A1 | 4/2004 | Ball |
| 2004/0068793 | A1 | 4/2004 | Ball |
| 2004/0103474 | A1 | 6/2004 | Ball |
| 2004/0107497 | A1 * | 6/2004 | Hirtriter ..... E03C 1/24 4/694 |
| 2004/0111797 | A1 | 6/2004 | Ball |
| 2004/0117907 | A1 | 6/2004 | Ball |
| 2004/0128757 | A1 | 7/2004 | Ball |
| 2004/0163165 | A1 | 8/2004 | Ortiz et al. |
| 2005/0022300 | A1 | 2/2005 | McEntire et al. |
| 2005/0035558 | A1 | 2/2005 | Dipzinski et al. |
| 2005/0050623 | A1 | 3/2005 | Greene |
| 2005/0108814 | A1 | 5/2005 | Thompson |
| 2006/0085907 | A1 | 4/2006 | Ball |
| 2006/0096018 | A1 | 5/2006 | Ball |
| 2006/0096019 | A1 | 5/2006 | Ball |
| 2006/0170208 | A1 | 8/2006 | Arning et al. |
| 2006/0218992 | A1 | 10/2006 | Ball et al. |
| 2006/0283792 | A1 | 12/2006 | McCallum |
| 2007/0007763 | A1 | 1/2007 | Deaton |
| 2007/0039098 | A1 | 2/2007 | Ball |
| 2007/0044218 | A1 | 3/2007 | Ball |
| 2007/0044230 | A1 | 3/2007 | Ball |
| 2007/0130689 | A1 | 6/2007 | Condon et al. |
| 2008/0028514 | A1 | 2/2008 | Lock et al. |
| 2008/0047060 | A1 | 2/2008 | Ball |
| 2008/0098504 | A1 | 5/2008 | Knox et al. |
| 2008/0098517 | A1 | 5/2008 | Ball |
| 2008/0148469 | A1 | 6/2008 | Dipzinski et al. |
| 2008/0148477 | A1 | 6/2008 | Shafik |
| 2008/0155745 | A1 | 7/2008 | Burr |
| 2008/0196161 | A1 | 8/2008 | Ball |
| 2008/0235866 | A1 | 10/2008 | Ball |
| 2009/0119826 | A1 | 5/2009 | Coronado |
| 2009/0172877 | A1 | 7/2009 | Ball |
| 2009/0173396 | A1 | 7/2009 | Spadavecchia |
| 2009/0250120 | A1 | 10/2009 | Robbins |
| 2009/0260154 | A1 | 10/2009 | Shoop et al. |
| 2009/0261579 | A1 | 10/2009 | Spears |
| 2010/0037392 | A1 | 2/2010 | Ball et al. |
| 2010/0163131 | A1 | 7/2010 | Fehr et al. |
| 2011/0035867 | A1 | 2/2011 | Coronado et al. |
| 2011/0154566 | A1 | 6/2011 | Shafik |
| 2011/0173747 | A1 | 7/2011 | Evans et al. |
| 2011/0209279 | A1 | 9/2011 | Ball |
| 2011/0289667 | A1 | 12/2011 | Oropallo et al. |
| 2012/0005824 | A1 | 1/2012 | Ball |
| 2012/0048070 | A1 | 3/2012 | Richter |
| 2012/0079654 | A1 | 4/2012 | Ball |
| 2012/0090084 | A1 | 4/2012 | Ball |
| 2012/0204345 | A1 | 8/2012 | Ball |
| 2012/0246822 | A1 | 10/2012 | Ball |
| 2013/0031720 | A1 | 2/2013 | Homami |
| 2013/0055494 | A1 | 3/2013 | Ball |
| 2013/0067648 | A1 | 3/2013 | Whitehead |
| 2013/0069361 | A1 | 3/2013 | Cai et al. |
| 2013/0180045 | A1 | 7/2013 | Ball et al. |
| 2013/0191988 | A1 | 8/2013 | Ball |
| 2013/0193042 | A1 | 8/2013 | Hull |
| 2013/0269100 | A1 | 10/2013 | Ball et al. |
| 2013/0283523 | A1 | 10/2013 | Ball |
| 2013/0340163 | A1 | 12/2013 | Ball et al. |
| 2014/0101834 | A1 | 4/2014 | Ball |
| 2014/0138297 | A1 | 5/2014 | Hull |
| 2014/0223659 | A1 | 8/2014 | Gay |
| 2015/0089736 | A1 | 4/2015 | Bird |
| 2015/0121617 | A1 | 5/2015 | Ball |
| 2015/0152627 | A1 | 6/2015 | Ball |
| 2015/0233103 | A1 | 8/2015 | Ball |
| 2015/0275487 | A1 | 10/2015 | Ball |
| 2016/0348810 | A1 | 12/2016 | Kipp |
| 2017/0247867 | A1 | 8/2017 | Ball |
| 2017/0356174 | A1 | 12/2017 | Humber et al. |
| 2018/0044899 | A1 | 2/2018 | Ball et al. |
| 2019/0376267 | A1 | 12/2019 | Ball |
| 2020/0018052 | A1 | 1/2020 | Ball |
| 2020/0232198 | A1 | 7/2020 | Ball |

FOREIGN PATENT DOCUMENTS

| | | | |
|---|---|---|---|
| DE | 419477 | 9/1925 | |
| DE | 1163257 | 3/1964 | |
| DE | 1784266 | 10/1971 | |
| DE | 3138912 | 4/1983 | |
| DE | 3621715 | 1/1988 | |
| DE | 9200488 | 3/1992 | |
| DE | 4206903 | 9/1993 | |
| DE | 3603877 | 1/1997 | |
| DE | 20118252 | 3/2003 | |
| EP | 0845559 | 6/1998 | |
| EP | 1936046 A2 * | 6/2008 | ..... E03C 1/244 |

(56) References Cited

FOREIGN PATENT DOCUMENTS

| | | |
|---|---|---|
| FR | 744099 | 4/1933 |
| FR | 1191141 | 10/1959 |
| FR | 2643097 | 8/1990 |
| GB | 1216208 | 12/1970 |
| GB | 1216285 | 12/1970 |
| GB | 2263060 | 7/1993 |
| GB | 2338184 | 12/1999 |
| JP | S53-58752 | 5/1978 |
| JP | H02-144074 | 12/1990 |
| JP | H05-15887 | 3/1993 |
| JP | H05-88393 | 12/1993 |
| JP | H09-108130 | 4/1997 |
| JP | 2000-513421 | 10/2000 |
| JP | 2003-313913 | 11/2003 |
| WO | WO 1999/24738 | 5/1999 |
| WO | WO 99/54560 | 10/1999 |
| WO | WO 02/063109 | 8/2002 |
| WO | WO 2004/074587 | 9/2004 |
| WO | WO 2009/063334 | 5/2009 |
| WO | WO 2013/112560 | 8/2013 |

OTHER PUBLICATIONS

"Geberit Installation Manual," Geberit, Dec. 12, 2012, 10 pages.
"New WATCO Eliminator Bath Waste", WATCO, as early as Aug. 8, 2001, pp. 1-2.
"OATEYSCS Supply Chain Services Catalog," Oatey Co., 2012, 334 pages.
"PRESS-IN" Trim Kit, AB&A™ IPS Corporation (date unknown) 2 pages.
"Push N' Repair Closet Flange," IPS Corporation, 2011, [retrieved Sep. 6, 2014], 1 page. Retrieved from: http://web.archive.org/web/20111013024522/http://ipscorp.com/watertite/cl-osetflanges/pushnrepair.
"PVC Scheduling 80 Fittings," Spears Manufacturing Co., May 28, 1996, 2 pages.
"Tubular Plastic-Innovator® 590", Woodford Manufacturing Company, first sold Aug. 16, 2001, pp. 1-2.
"Ultralite®—Type NM (Liquidtight Flexible Nonmetallic Conduit)", Southwire Company brochure/pamphlet, as early as 2003, printed on Dec. 14, 2008, pp. 1-3.
"WCM Industries—Freezeless Faucets, Yard Hydrants and Bath Wastes", as early as Aug. 2000, available at http://www.woodfordmfg.com/, printed on Sep. 15, 2005, p. 1.
"Why choose a Geberit Cable Driven Bath Waste Overflow?" Geberit, date unknown, 2 pages.
Answer and Counterclaim, *WCM Industries, Inc.* v. *IPS Corporation, et al.*, U.S. District Court, Western District of Tennessee, Western Division, Case No. 2:13-cv-02019-JPM-tmp, filed Feb. 19, 2013, 16 pages.
Canadian Examiner's Report for Application No. 2,556,523, dated Feb. 16, 2009, 2 pages.
Canadian Notice of Allowance for Patent Application No. 2,557,022, dated Mar. 17, 2009, 1 page.
Canadian Official Action for Patent Application No. 2,557,022, dated Nov. 28, 2008, 2 pgs.
Canadian Official Action for Patent Application No. 2,642,379, dated Nov. 7, 2014, 3 pages.
Complaint (with Exhibits A-J), *WCM Industries, Inc.* v. *IPS Corporation, et al.*, U.S. District Court, Western District of Tennessee, Western Division, Case No. 2:13-cv-02019-JPM-tmp, filed Jan. 9, 2013, 117 pages.
Complaint for Delaratory Relief (with Exhibits 1-7), *IPS Corporation* v. *WCM Industries, Inc.*, United States District Court for the Western District of Tennessee, Case No. 2:12-cv-02694, filed Aug. 9, 2012, 58 pages.
Declaration of Wolpert and Exhibits A-D, *WCM Industries, Inc.* v. *IPS Corporation, et al.*, U.S. District Court, Western District of Tennessee, Western Division, Case No. 2:13-cv-02019-JPM-dkv, Oct. 22, 2014, 21 pages.
Defendant WCM Industries, Inc's Answer to Complaint, Affirmative Defenses and Counterclaims Against IPS Corporation, *IPS Corporation* v. *WCM Industries, Inc.*, United States District Court for the Western District of Tennessee, Case No. 2:12-cv-02694-JPM-tmp, filed Apr. 12, 2013, 10 pages.
Definition of the term "diaphragm" found at: http://www.thefreedictionary.com/diaphragm, cited in Aug. 7, 2012 OA for U.S. Appl. No. 13/234,030.
European Extended Search Report in Application 12002970.7, dated Mar. 25, 2014, 9 pages.
Great Britain Examination and Search Report for United Kingdom Patent Application No. GB1118043.7, dated Oct. 31, 2011 6 pages.
IPS Corporation's Initial Non-Infringement Contentions (with Exhibit A), *IPS Corporation* v. *WCM Industries, Inc.*, United States District Court for the Western District of Tennessee, Case No. 2:12-cv-02694-JPM-dkv, dated Jun. 7, 2013, 5 pages.
Mexican Notice of Allowance for Patent Application No. MX/a/2008/013956, dated Nov. 16, 2011, 1 page.
Mexican Official Action (with partial English summary) for Mexican Patent Application No. MX/a/2012/002782 dated Dec. 1, 2014, 3 pages.
Mexican Official Action for Patent Application No. PA/a/2005/011301, dated Mar. 18, 2010 3 pages.
Mexican Official Action for Patent Application No. PA/a/2005/011301, dated Oct. 20, 2010, 2 pgs.
PCT International Search Report for International Patent Application No. PCT/US03/09439, dated Sep. 9, 2003, 1 page.
Plaintiff IPS Corporation's Answer to Defendant WCM Industries, Inc's Counterclaims, *Corporation* v. *WCM Industries, Inc.*, United States District Court for the Western District of Tennessee, Case No. 2:12-cv-02694-JPM-tmp, filed May 3, 2013, 5 pages.
Plaintiff IPS's Final Invalidity Contentions (Exhibit A), *IPS Corporation* v. *WCM Industries, Inc.*, United States District Court for the Western District of Tennessee, Case No. 2:12-cv-02694-JPM-dkv, dated Feb. 23, 2015, 3 pages.
Plaintiff IPS's Final Invalidity Contentions (Exhibit B-1), *IPS Corporation* v. *WCM Industries, Inc.*, United States District Court for the Western District of Tennessee, Case No. 2:12-cv- 02694-JPM-dkv, dated Feb. 23, 2015, 951 pages.
Plaintiff IPS's Final Invalidity Contentions (Exhibit B-2), *IPS Corporation* v. *WCM Industries, Inc.*, United States District Court for the Western District of Tennessee, Case No. 2:12-cv- 02694-JPM-dkv, dated Feb. 23, 2015, 1003 pages.
Plaintiff IPS's Final Invalidity Contentions (Exhibit B-3), *IPS Corporation* v. *WCM Industries, Inc.*, United States District Court for the Western District of Tennessee, Case No. 2:12-cv- 02694-JPM-dkv, dated Feb. 23, 2015, 351 pages.
Plaintiff IPS's Final Invalidity Contentions (Exhibit B-7), *IPS Corporation* v. *WCM Industries, Inc.*, United States District Court for the Western District of Tennessee, Case No. 2:12-cv- 02694-JPM-dkv, dated Feb. 23, 2015, 531 pages.
Plaintiff IPS's Final Invalidity Contentions (Exhibit B-8), *IPS Corporation* v. *WCM Industries, Inc.*, United States District Court for the Western District of Tennessee, Case No. 2:12-cv- 02694-JPM-dkv, dated Feb. 23, 2015, 1219 pages.
Plaintiff IPS's Final Invalidity Contentions, *IPS Corporation* v. *WCM Industries, Inc.*, United States District Court for the Western District of Tennessee, Case No. 2:12-cv-02694-JPM-dkv, dated Feb. 23, 2015, 17 pages.
Plaintiff IPS's Initial Invalidity Contentions (with Exhibits A and B), *IPS Corporation* v. *WCM Industries, Inc.*, United States District Court for the Western District of Tennessee, Case No. 2:12-cv-02694-JPM-dkv, dated Aug. 6, 2013, 78 pages.
Reply to Defendant's Counterclaims, *IPS Corporation* v. *WCM Industries, Inc.*, U.S. District Court, Western District of Tennessee, Western Division, Case No. 2:13-cv-02019-JPM-tmp, filed Mar. 12, 2013, 4 pages.
U.S. Appl. No. 09/593,724 entitled "Method and Means for an Overflow Assembly to Bathtubs and the Like", by William T. Ball, filed Jun. 13, 2000, 14 pages.
U.S. Appl. No. 10,326,449, Office Action dated Jan. 13, 2004, 8 pages.

(56) References Cited

OTHER PUBLICATIONS

U.S. Appl. No. 10,326,449, Office Action dated Oct. 15, 2003, 7 pages.
U.S. Appl. No. 10,326,449, Office Action dated Jun. 4, 2003, 6 pages.
U.S. Appl. No. 10/247,247, Office Action dated Dec. 4, 2006, 9 pages.
U.S. Appl. No. 10/247,247, Office Action dated Feb. 17, 2006, 10 pages.
U.S. Appl. No. 10/247,247, Office Action dated Apr. 5, 2004, 8 pages.
U.S. Appl. No. 10/247,247, Office Action dated May 1, 2008, 7 pages.
U.S. Appl. No. 10/247,247, Office Action dated May 4, 2005, 12 pages.
U.S. Appl. No. 10/247,247, Office Action dated Jul. 19, 2006, 5 pages.
U.S. Appl. No. 10/247,247, Office Action dated Aug. 27, 2003, 10 pages.
U.S. Appl. No. 10/370,545, Notice of Allowance dated Jun. 20, 2006, 6 pages.
U.S. Appl. No. 10/370,545, Office Action dated Jan. 25, 2005, 13 pages.
U.S. Appl. No. 10/370,545, Office Action dated Jan. 26, 2004, 9 pages.
U.S. Appl. No. 10/370,545, Office Action dated Sep. 11, 2003, 12 pages.
U.S. Appl. No. 10/674,739, Office Action dated Dec. 19, 2005, 10 pages.
U.S. Appl. No. 10/674,739, Office Action dated May 18, 2004, 6 pages.
U.S. Appl. No. 10/674,739, Office Action dated May 5, 2006, 7 pages.
U.S. Appl. No. 10/674,739, Office Action dated Aug. 25, 2006, 6 pages.
U.S. Appl. No. 10/674,739, Office Action dated Sep. 30, 2005, 11 pages.
U.S. Appl. No. 10/674,862, Examiner's Answer dated May 15, 2008, 12 pgs.
U.S. Appl. No. 10/674,862, Notice of Allowance dated Aug. 24, 2006, 4 pgs.
U.S. Appl. No. 10/674,862, Office Action dated Aug. 18, 2004, 5 pgs.
U.S. Appl. No. 10/674,862, Office Action dated Dec. 21, 2006, 10 pgs.
U.S. Appl. No. 10/674,862, Office Action dated Mar. 28, 2005, 8 pgs.
U.S. Appl. No. 10/674,862, Office Action dated May 1, 2007, 10 pgs.
U.S. Appl. No. 10/674,862, Office Action dated Oct. 6, 2005, 6 pgs.
U.S. Appl. No. 10/674,862, Office Action dated Sep. 20, 2005, 6 pgs.
U.S. Appl. No. 10/674,862, Official Communication dated May 23, 2008, 2 pgs.
U.S. Appl. No. 10/721,694, Office Action dated Oct. 6, 2005, 11 pages.
U.S. Appl. No. 10/721,694, Office Action dated Mar. 13, 2009, 9 pages.
U.S. Appl. No. 10/721,694, Office Action dated Mar. 24, 2005, 10 pages.
U.S. Appl. No. 10/721,694, Office Action dated Mar. 27, 2007, 9 pages.
U.S. Appl. No. 10/721,694, Office Action dated Apr. 10, 2006, 9 pages.
U.S. Appl. No. 10/721,694, Office Action dated May 18, 2004, 7 pages.
U.S. Appl. No. 10/721,694, Office Action dated Jul. 23, 2004, 6 pages.
U.S. Appl. No. 10/721,694, Office Action dated Aug. 14, 2006, 6 pages.
U.S. Appl. No. 10/721,694, Office Action dated Aug. 27, 2007, 8 pages.
U.S. Appl. No. 10/732,726, Notice of Allowance dated Sep. 20, 2012, 5 pages.
U.S. Appl. No. 10/732,726, Office Action dated Apr. 15, 2010, 16 pgs.
U.S. Appl. No. 10/732,726, Office Action dated Aug. 20, 2008 (Examiner Answer to Appeal Brief), 2 pgs.
U.S. Appl. No. 10/732,726, Office Action dated Dec. 9, 2008, 12 pgs.
U.S. Appl. No. 10/732,726, Office Action dated Jan. 30, 2008 (Examiner Answer to Appeal Brief), 8 pgs.
U.S. Appl. No. 10/732,726, Office Action dated Jun. 2, 2008 (Examiner Answer to Appeal Brief), 2 pgs.
U.S. Appl. No. 10/732,726, Office Action dated Mar. 28, 2005 (Restriction Requirement), 4 pgs.
U.S. Appl. No. 10/732,726, Office Action dated May 1, 2008, 2 pgs.
U.S. Appl. No. 10/732,726, Office Action dated May 19, 2006 (Examiner Answer to Appeal Brief), 9 pgs.
U.S. Appl. No. 10/732,726, Office Action dated May 23, 2005, 10 pgs.
U.S. Appl. No. 10/732,726, Office Action dated May 9, 2011 9 pages.
U.S. Appl. No. 10/732,726, Office Action dated Nov. 16, 2011 9 pages.
U.S. Appl. No. 10/732,726, Office Action dated Nov. 17, 2008 (Dismissal of Appeal), 3 pgs.
U.S. Appl. No. 10/732,726, Office Action dated Oct. 24, 2005, 11 pgs.
U.S. Appl. No. 10/732,726, Office Action dated Oct. 25, 2010, 12 pgs.
U.S. Appl. No. 10/732,726, Office Action dated Sep. 4, 2009, 11 pgs.
U.S. Appl. No. 10/732,726, Office Action dated Sep. 4, 2012, 5 pages.
U.S. Appl. No. 10/738,765, Office Action dated Apr. 13, 2006, 2 pgs.
U.S. Appl. No. 10/738,765, Office Action dated Jan. 13, 2006, 8 pgs.
U.S. Appl. No. 10/738,765, Office Action dated Jun. 6, 2005, 9 pgs.
U.S. Appl. No. 10/738,765, Office Action dated May 22, 2007, 6 pgs.
U.S. Appl. No. 10/738,772, Advisory Action dated May 11, 2006, 3 pgs.
U.S. Appl. No. 10/738,772, Advisory Action dated May 13, 2005, 3 pgs.
U.S. Appl. No. 10/738,772, Notice of Allowance dated Aug. 1, 2006, 5 pages.
U.S. Appl. No. 10/738,772, Notice of Allowance dated Aug. 21, 2006, 1 page.
U.S. Appl. No. 10/738,772, Notice of Allowance dated May 11, 2006, 3 pgs.
U.S. Appl. No. 10/738,772, Notice of Allowance dated Sep. 17, 2004, 8 pgs.
U.S. Appl. No. 10/738,772, Office Action dated May 13, 2005, 3 pgs.
U.S. Appl. No. 10/738,772, Office Action dated Aug. 2, 2005, 9 pgs.
U.S. Appl. No. 10/738,772, Office Action dated Mar. 11, 2005, 10 pgs.
U.S. Appl. No. 10/738,772, Office Action dated Mar. 27, 2006, 6 pgs.
U.S. Appl. No. 10/738,772, Office Action dated Sep. 17, 2004, 9 pgs.
U.S. Appl. No. 10/971,895, Office Action dated Apr. 25, 2007, 8 pgs.
U.S. Appl. No. 10/971,895, Office Action dated Oct. 12, 2007, 9 pgs.
U.S. Appl. No. 11/161,930, Notice of Allowance dated Sep. 15, 2008, 6 pgs.
U.S. Appl. No. 11/161,930, Office Action dated Feb. 20, 2008, 6 pages.
U.S. Appl. No. 11/161,933, Notice of Allowance dated Jan. 29, 2009, 6 pgs.
U.S. Appl. No. 11/161,933, Office Action dated Jun. 23, 2008, 7 pgs.

(56) References Cited

OTHER PUBLICATIONS

U.S. Appl. No. 11/423,996, Office Action dated Dec. 5, 2006, 9 pages.
U.S. Appl. No. 11/423,996, Office Action dated Apr. 16, 2007, 13 pages.
U.S. Appl. No. 11/423,996, Office Action dated Jul. 7, 2006, 9 pages.
U.S. Appl. No. 11/873,200 entitled "Shower Station Testing Assembly for Pressure Testing Plumbing", by Wiliam T. Ball, filed Oct. 16, 2007, 24 pages.
U.S. Appl. No. 11/931,681, Notice of Allowance dated Aug. 4, 2011 8 pages.
U.S. Appl. No. 11/931,681, Office Action dated Apr. 26, 2011 15 pages.
U.S. Appl. No. 12/057,660, Notice of Allowance for dated Mar. 7, 2012 5 pages.
U.S. Appl. No. 12/057,660, Office Action dated Nov. 3, 2011 9 pages.
U.S. Appl. No. 12/100,762, Office Action dated Jan. 31, 2014, 10 pages.
U.S. Appl. No. 12/100,762, Office Action dated Feb. 1, 2012, 9 pages.
U.S. Appl. No. 12/100,762, Office Action dated Aug. 13, 2014 9 pages.
U.S. Appl. No. 12/100,762, Office Action dated Sep. 15, 2011 9 pages.
U.S. Appl. No. 12/405,956, Office Action dated Oct. 14, 2010, 8 pages.
U.S. Appl. No. 12/896,137, Notice of Allowance dated May 15, 2014, 5 pages.
U.S. Appl. No. 12/896,137, Office Action dated Feb. 24, 2014, 6 pages.
U.S. Appl. No. 12/896,137, Office Action dated Sep. 5, 2013, 10 pages.
U.S. Appl. No. 13/041,929, Notice of Allowance dated Feb. 11, 2015 7 pages.
U.S. Appl. No. 13/041,929, Notice of Allowance dated Mar. 11, 2015 4 pages.
U.S. Appl. No. 13/041,929, Notice of Allowance dated Mar. 31, 2015 4 pages.
U.S. Appl. No. 13/041,929, Office Action dated Dec. 18, 2013 (Restriction Requirement), 6 pages.
U.S. Appl. No. 13/041,929, Office Action dated May 8, 2014 12 pages.
U.S. Appl. No. 13/234,030, Notice of Allowance dated Oct. 19, 2012 5 pages.
U.S. Appl. No. 13/234,030, Office Action dated Apr. 12, 2012, 15 pages.
U.S. Appl. No. 13/234,030, Office Action dated Aug. 7, 2012 13 pages.
U.S. Appl. No. 13/274,804, Notice of Allowance dated Apr. 23, 2014, 6 pages.
U.S. Appl. No. 13/274,804, Office Action dated Dec. 24, 2013, 10 pages.
U.S. Appl. No. 13/461,422, Notice of Allowance dated Apr. 18, 2013, 6 pages.
U.S. Appl. No. 13/461,422, Office Action dated Dec. 27, 2012 9 pages.
U.S. Appl. No. 13/669,417, Notice of Allowance dated Nov. 15, 2013, 5 pgs.
U.S. Appl. No. 13/669,417, Notice of Allowance dated Sep. 27, 2013, 9 pgs. 9 pages.
U.S. Appl. No. 13/669,417, Office Action dated Mar. 1, 2013, 7 pgs. 12 pages.
U.S. Appl. No. 13/691,405, Notice of Allowance dated Oct. 9, 2013, 7 pages.
U.S. Appl. No. 13/691,405, Office Action dated Aug. 14, 2013, 5 pages.
U.S. Appl. No. 13/726,840, Notice of Allowance dated Apr. 27, 2015, 7 pages.
U.S. Appl. No. 13/894,626, Notice of Allowance dated Aug. 10, 2015 5 pages.
U.S. Appl. No. 13/894,626, Notice of Allowance dated Oct. 29, 2015 4 pages.
U.S. Appl. No. 13/894,626, Office Action dated Jul. 16, 2015 7 pages.
U.S. Appl. No. 13/974,690, Notice of Allowance dated Jun. 15, 2015, 5 pages.
U.S. Appl. No. 13/974,690, Office Action dated Apr. 22, 2015, 9 pages.
U.S. Appl. No. 14/074,442, Office Action dated Oct. 7, 2015, 12 pages.
U.S. Appl. No. 14/074,442, Office Action dated Feb. 12, 2016, 13 pages.
U.S. Appl. No. 14/109,503, Notice of Allowance dated Mar. 11, 2015, 8 pages.
U.S. Appl. No. 14/109,503, Office Action dated Aug. 18, 2014, 6 pages.
U.S. Appl. No. 14/109,503, Office Action dated Dec. 29, 2014, 10 pages.
U.S. Appl. No. 14/618,594, Office Action dated Feb. 11, 2016, 14 pages.
U.S. Appl. No. 14/618,594, Office Action dated May 22, 2015, 13 pages.
U.S. Appl. No. 14/701,091, Notice of Allowance dated Oct. 29, 2015, 5 pages.
U.S. Appl. No. 14/701,091, Office Action dated Oct. 15, 2015, 8 pages.
U.S. Appl. No. 14/701,091, Office Action dated Jul. 15, 2015, 7 pages.
U.S. Appl. No. 14/710,351, Notice of Allowance dated Jan. 30, 2017, 7 pages.
U.S. Appl. No. 14/710,351, Office Action dated Dec. 16, 2016, 7 pages.
U.S. Appl. No. 15/596,582, Notice of Allowance dated Feb. 4, 2019, 7 pages.
U.S. Appl. No. 15/596,582, Office Action dated Jul. 18, 2018, 7 pages.
U.S. Appl. No. 15/597,691 Notice of Allowance dated Jan. 15, 2020, 5 pages.
U.S. Appl. No. 15/597,691, Notice of Allowance dated Oct. 2, 2019, 9 pages.
U.S. Appl. No. 15/597,691, Office Action dated Oct. 5, 2018, 11 pages.
U.S. Appl. No. 15/597,691, Office Action dated Apr. 19, 2019, 11 pages.
U.S. Appl. No. 15/675,306, Notice of Allowance dated May 30, 2019, 7 pages.
U.S. Appl. No. 15/675,306, Notice of Allowance dated Jun. 19, 2019, 4 pages.
U.S. Appl. No. 15/675,306, Notice of Allowance dated Sep. 6, 2019, 4 pages.
U.S. Appl. No. 15/675,306, Office Action dated Mar. 8, 2019, 14 pages.
U.S. Appl. No. 15/675,306, Office Action dated Aug. 8, 2018, 12 pages.
U.S. Appl. No. 29/360,523, Corrected Notice of Allowance dated Mar. 16, 2011 3 pages.
U.S. Appl. No. 29/360,523, Notice of Allowability dated Jan. 11, 2011, 4 pgs.
U.S. Appl. No. 29/360,523, Office Action dated Oct. 5, 2010, 8 pgs.
U.S. Appl. No. 29/360,523, Office Action dated Dec. 23, 2010, 6 pgs.
U.S. Appl. No. 29/360,524, Notice of Allowability dated Oct. 7, 2010, 11 pgs.
U.S. Appl. No. 29/362,288, Notice of Allowability dated Oct. 7, 2010, 8 pgs.
U.S. Appl. No. 29/378,602, Notice of Allowance dated Jun. 21, 2012 7 pages.
U.S. Appl. No. 29/378,602, Office Action dated Mar. 9, 2012 6 pages (Restriction Requirement).
U.S. Appl. No. 29/378,602, Office Action dated Mar. 27, 2012 5 pages.

(56) References Cited

OTHER PUBLICATIONS

U.S. Appl. No. 29/396,333, Notice of Allowance dated Nov. 5, 2012, 7 pages.
U.S. Appl. No. 29/396,333, Office Action dated Jul. 31, 2012, 6 pgs.
U.S. Appl. No. 29/396,333, Supplemental Notice of Allowance dated Dec. 6, 2012, 4 pages.
U.S. Appl. No. 29/484,008, Notice of Allowance dated Jan. 2, 2015, 9 pages.
U.S. Appl. No. 13/456,017, Notice of Allowance dated Feb. 4, 2015, 6 pgs.
U.S. Appl. No. 16/450,548, Office Action dated Sep. 21, 2020, 9 pages.
U.S. Appl. No. 16/583,918, Office Action dated Feb. 2, 2021, 10 pages.
U.S. Appl. No. 16/583,918, Office Action dated May 3, 2021, 7 pages.
U.S. Appl. No. 16/750,986, Office Action dated Mar. 10, 2021, 12 pages.
U.S. Appl. No. 16/583,918, Notice of Allowance dated Jul. 21, 2021, 7 pages.
U.S. Appl. No. 16/750,986, Notice of Allowance dated Jun. 16, 2021, 8 pages.

* cited by examiner

OVERFLOW COVERS AND OVERFLOW SYSTEMS FOR BATHTUBS

CROSS-REFERENCE TO RELATED APPLICATIONS

This application claims priority to and the benefit of U.S. Provisional Application No. 62/989,222, filed Mar. 13, 2020, the disclosure of which is hereby incorporated by reference herein in its entirety.

INTRODUCTION

A bathtub generally has a drain system positioned in a bottom of the bathtub that allows for selective opening and closing so that the bathtub can retain water. Additionally, an overflow system is provided so that once the water within the bathtub reaches a predetermined height, water can drain from the bathtub to reduce or prevent water from overflowing the bathtub and flowing onto the floor. The overflow system connects the bathtub's overflow port to a wastewater system and includes an opening that enables water to flow from the bathtub to the wastewater system.

SUMMARY

In an aspect, the technology relates to an overflow system for concealing an overflow conduit of a bathtub, the overflow system including: a nut including: an inner mount configured to secure to the overflow conduit, wherein the inner mount is substantially circular in shape; and an outer mount including a plurality of engagement sections that extend substantially tangential to the inner mount, wherein the inner mount has a thickness that is greater than a thickness of the outer mount, and the outer mount is centered on and integral with the inner mount; and an overflow cover configured to couple to the nut, wherein the overflow cover is substantially square and includes: a front wall; and a plurality of side walls, each having a first end extending from the front wall and an opposite second end, wherein the second end includes a lip configured to engage with a respective engagement section of the plurality of engagement sections when the overflow cover is coupled to the nut.

In an example, a length of the lip is approximately equal to a length of the respective engagement section. In another example, each of the plurality of engagement sections are a linear portion and the outer mount further includes curved portions disposed at both ends of each linear portion. In yet another example, when the overflow cover is coupled to the nut the curved portions curve away from the respective side wall of the plurality of side walls. In still another example, adjacent curved portions are coupled together at a corner. In an example, each of the plurality of engagement sections have a point of tangency with respect to the inner mount that are spaced approximately 90° from each other. In another example, each of the plurality of engagement sections have approximately the same length.

In another aspect, the technology relates to an overflow system for concealing an overflow conduit of a bathtub, the overflow system including: a nut including: an inner radial surface at least partially defining an inner mount configured to secure to the overflow conduit; and an outer surface at least partially defining an outer mount, the outer surface being planer in an axial direction of the nut and including a plurality of engagement sections that extend tangential to the inner mount; and an overflow cover having a body with an outer surface and an inner surface, the inner surface defines an inner cavity shaped and sized to receive the nut and at least a portion of the overflow conduit, wherein when the overflow cover is coupled to the nut, the plurality of engagement sections of the nut engage with the inner surface of the overflow cover to removably couple the overflow cover to the nut.

In an example, the inner surface of the overflow cover includes one or more lips configured to engage with a respective engagement section of the plurality of engagement sections. In another example, the one or more lips and the plurality of engagement sections are linear. In yet another example, each of the plurality of engagement sections have a length that is greater than one-third of a diameter of the inner radial surface. In still another example, the inner mount has a thickness that is greater than a thickness of the outer mount, and the outer mount is centered on and integral with the inner mount. In an example, a corner extends between adjacent engagement sections of the plurality of engagement sections and the corner is spaced apart from the inner mount via an opening.

In another aspect, the technology relates to an overflow system for a bathtub including: an overflow conduit configured to secure to the bathtub at an overflow port and at least partially extend into the bathtub, wherein the overflow conduit has an outer surface that defines a first perimeter with an outer cross-sectional shape; an overflow cover configured to at least partially cover the overflow conduit within the bathtub, the overflow cover including: a front wall having an inner surface and an outer surface, wherein when the overflow cover covers the overflow conduit the inner surface faces the overflow conduit; and a plurality of side walls each having a first end and an opposite second end, the first end extending from the inner surface of the front wall and the second end when the overflow cover covers the overflow conduit is positioned adjacent the bathtub, wherein the plurality of side walls each also have an inner surface that defines a second perimeter with an inner cross-sectional shape, the inner cross-sectional shape being different from the outer cross-sectional shape of the overflow conduit; and a nut configured to secure to the overflow conduit and couple the overflow cover to the overflow conduit, the nut including: an inner mount configured to secure to the outer surface of the overflow conduit; and an outer mount configured to engage with at least a portion of the inner surfaces of the plurality of side walls of the overflow cover such that the overflow cover is removably coupled to the nut.

In an example, the outer mount of the nut includes a plurality of engagement sections having an outer surface being planer in an axial direction of the nut, and the outer surface of the plurality of engagement sections correspond at least partially to the inner cross-sectional shape of the plurality of side walls of the overflow cover. In another example, each of the plurality of engagement sections has a length that extends substantially tangential to the inner mount. In yet another example, the outer mount of the nut includes one or more corners that connect adjacent engagement sections of the plurality of engagement sections. In still another example, the one or more corners are at least partially curved relative to the length of each of the plurality of engagement sections. In an example, the inner mount has a thickness that is greater than a thickness of the outer mount, and the outer mount is centered on and integral with the inner mount. In another example, at least a portion of one or more of the second end of the plurality of side walls of the overflow cover include an inwardly extending lip that is configured to engage with a respective engagement section of the plurality of engagement sections of the nut.

BRIEF DESCRIPTION OF THE DRAWINGS

There are shown in the drawings examples that are presently preferred, it being understood, however, that the invention is not limited to the precise arrangements and configurations shown.

DETAILED DESCRIPTION

Figure 1:
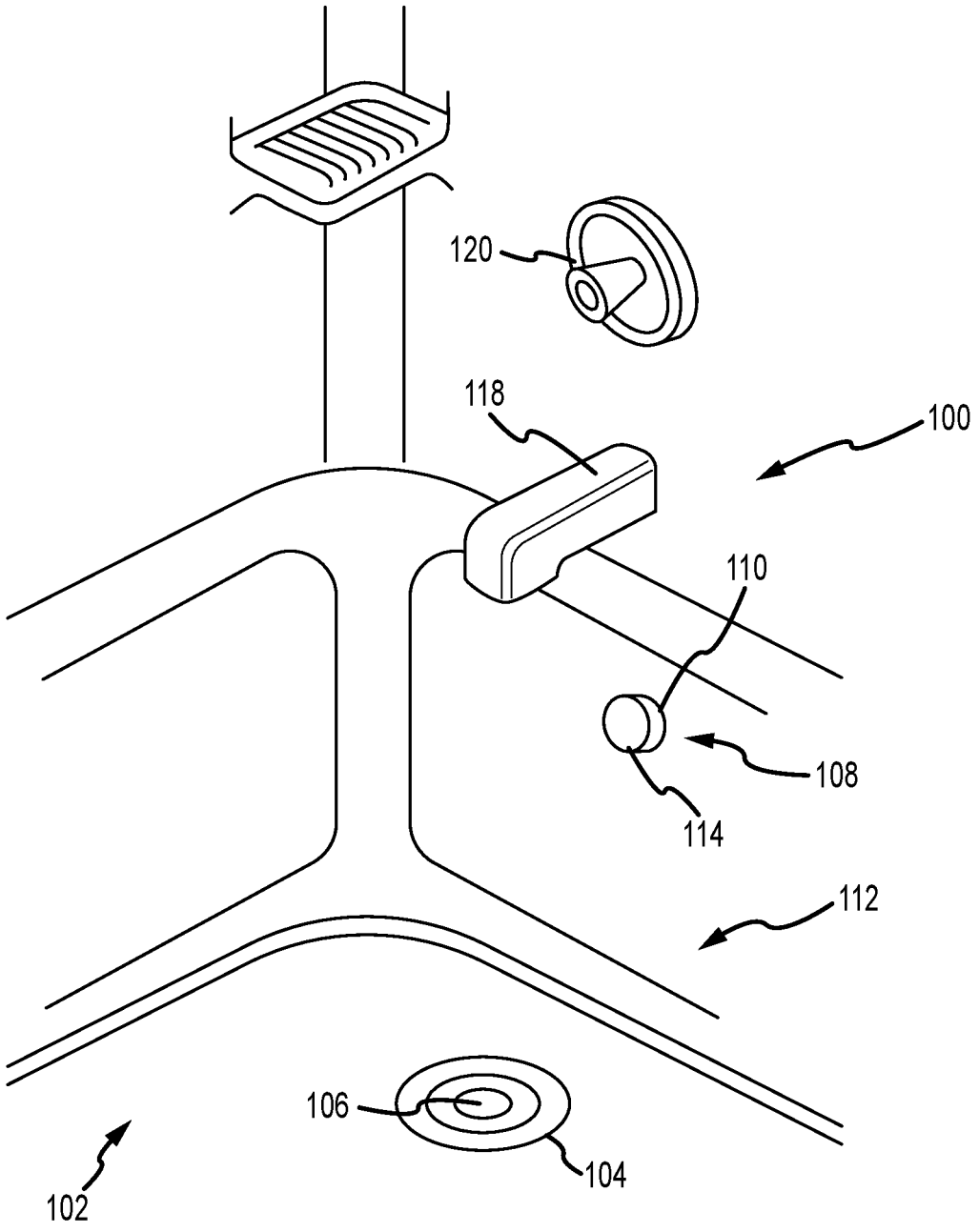
FIG. 1 is a partial perspective view of an exemplary bathtub.

FIG. 1 is a partial perspective view of an exemplary bathtub 100. A bottom 102 of the bathtub 100 includes a drain port 104 with a tub closure assembly 106 coupled thereto. The tub closure assembly 106 can be opened and closed so as to control water retention in the bathtub 100. Additionally, an overflow system 108 couples to the bathtub 100 and enables water to be drained from the bathtub 100 at a second location. The overflow system 108 is coupled to an overflow port 110 defined in a wall 112 of the bathtub 100 and includes an overflow conduit 114 that at least partially extends into the bathtub 100. The overflow conduit 114 allows water to drain from the bathtub 100 so as to reduce or prevent bathtub overflows. The overflow system 108 further includes an overflow cover 116 (shown in FIG. 2) that is configured to be coupled over the overflow conduit 114 and provide an aesthetic finish to the bathtub 100. The overflow system 108 is described further below in reference to FIG. 2. To provide water to the bathtub 100, a faucet 118 and a control assembly 120 can be provided.

Figure 2:
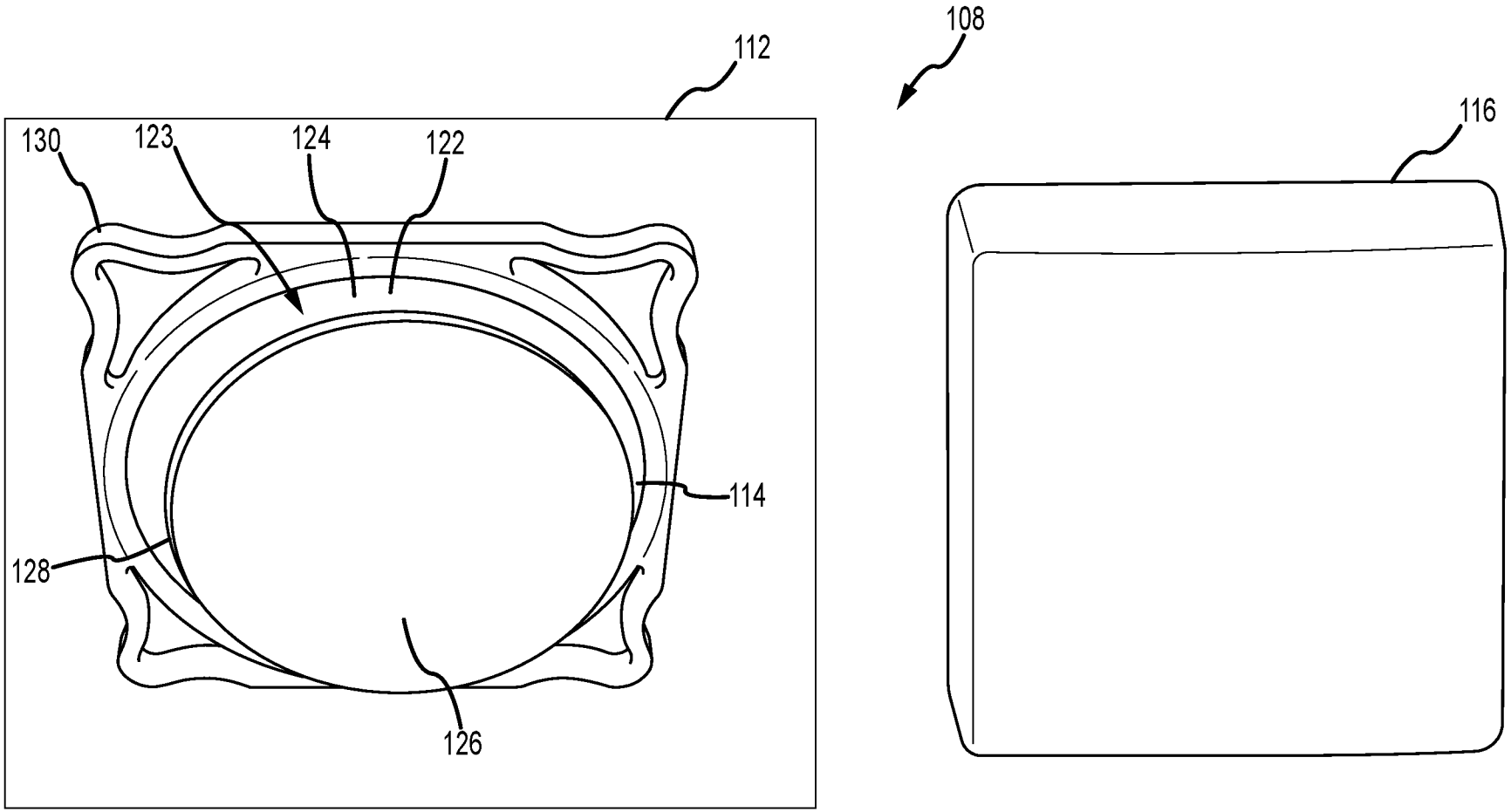
FIG. 2 is an exploded perspective view of an exemplary overflow system for the bathtub shown in FIG. 1.

FIG. 2 is an exploded perspective view of the overflow system 108 for the bathtub 100 (shown in FIG. 1). The overflow system 108 includes the overflow conduit 114 that is configured to secure to the bathtub wall 112 at the overflow port. In an aspect, the overflow conduit 114 can be an upper portion of an elbow with an approximately 90° bend (not shown). In some examples, the elbow can include a flange that is positioned against the outside of the bathtub wall 112. In another aspect, the overflow conduit 114 can be a straight pipe that couples to an elbow component or a flexible pipe at the outside of the bathtub wall 112. As illustrated in FIG. 2, the overflow conduit 114 has a body 122 that extends through the bathtub wall 112. In the example, the body 122 is a substantially cylindrical in shape with an outer surface 123 that is threaded 124 and an inner surface (not shown) that defines an interior passageway which enables water to flow out of the bathtub wall 112 via the overflow conduit 114. The outer surface 123 of the body 122 defines a perimeter of the overflow conduit 114 that has a substantially circular outer cross-sectional shape.

A diaphragm 126 can be coupled to a front wall 128 of the body 122. The diaphragm 126 seals an interior passageway of the overflow conduit 114 so that the overflow system 108 can be leak tested before use. In examples, a wastewater system that the overflow conduit 114 is coupled to and that drains wastewater from the bathtub is pressurized (e.g., via water or pressurized air) in order to check for leaks in the system. The diaphragm 126 seals the overflow conduit 114 to enable this leak testing. Once a leak proof wastewater system is confirmed, the diaphragm 126 can be removed to allow access into the interior passageway of the overflow conduit 114. In some examples, the overflow system 108 can include a washer (not shown) that is positioned behind the bathtub wall 112 and used to facilitate a watertight seal between the bathtub wall 112 and the overflow conduit 114.

To secure the overflow conduit 114 on the bathtub wall 112, the overflow system 108 includes a nut 130 that is used. The nut 130 is configured to secure to the overflow conduit 114 and is used to couple the overflow cover 116 to the body 122 of the overflow conduit 114 without the overflow cover 116 being directly engaged with the overflow conduit 114. The configuration of the overflow conduit 114, the overflow cover 116, and the nut 130 (e.g., the overflow system 108) enables overflow drainage of the bathtub while providing an aesthetically pleasing design, for example, the overflow cover 116 that is free from any exterior fastener or connector elements while being able to conceal both the body 122 of the overflow conduit 114 and the nut 130. In the example, the nut 130 is threaded onto the body 122 of the overflow conduit 114 until the nut 130 is adjacent the bathtub wall 112.

The nut 130 is configured to receive and couple to the overflow cover 116 so as to hold the cover 116 on the bathtub wall 112 and conceal the body 122 of the overflow conduit 114. The overflow cover 116 is illustrated as being decoupled from the nut 130 for clarity in FIG. 2. The overflow system 108 described herein also allows the interior passageway for the overflow conduit 114 to be free of any obstacles that restrict overflow drainage, for example, fasteners or support bars (not shown) that extend across the interior passageway. Additionally, as described further herein, the nut 130 is configured to allow the overflow cover 116 to be formed in a different shape from the body 122 of the overflow conduit 114 and further increase the aesthetic design options for the cover 116. For example, the substantially circular outer cross-sectional shape of the overflow conduit 114 is different from the substantially square shape of the overflow cover 116, as illustrated in FIG. 2.

Figure 3:
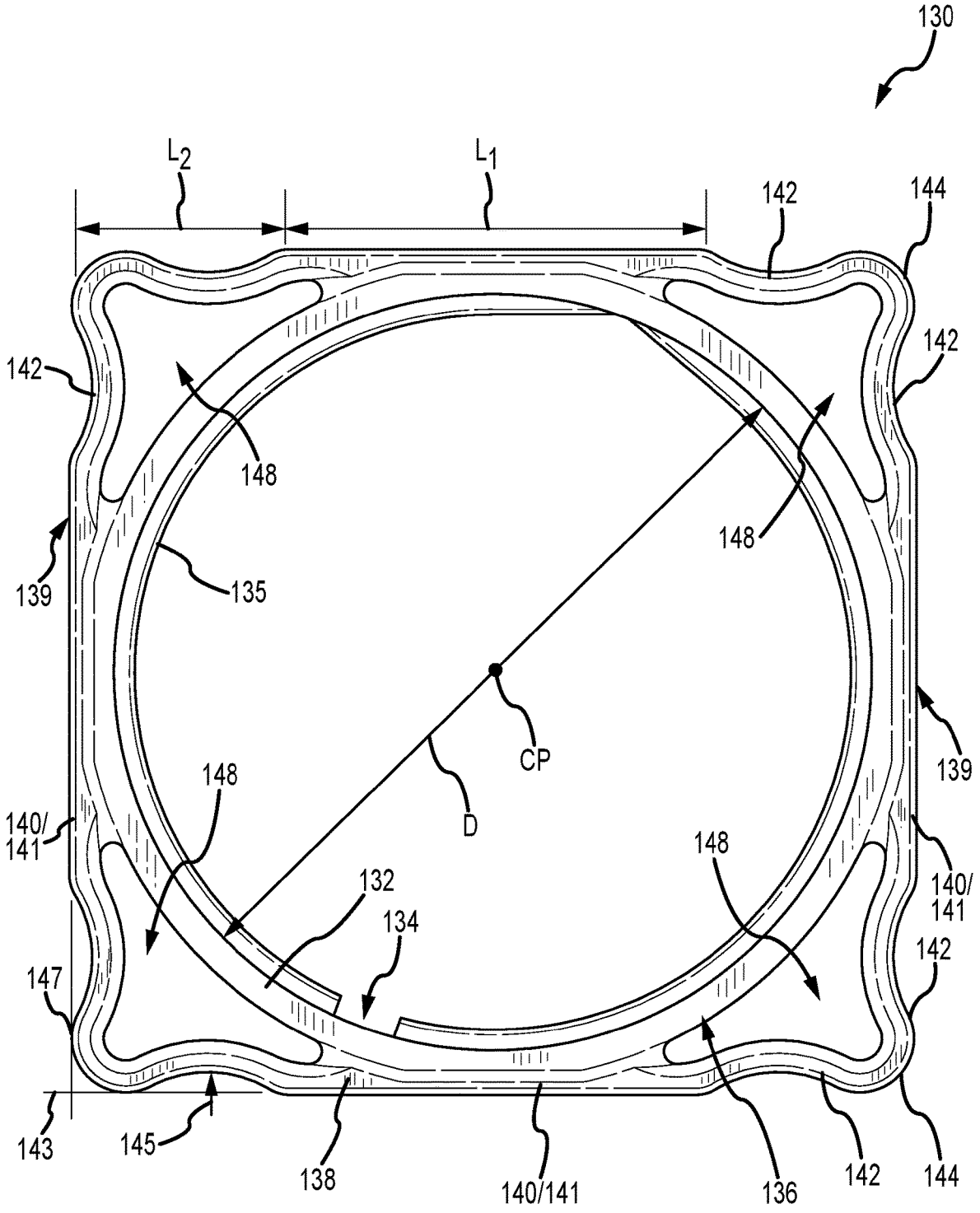
FIG. 3 is an end view of a nut of the overflow system shown in FIG. 2.
Figure 4:
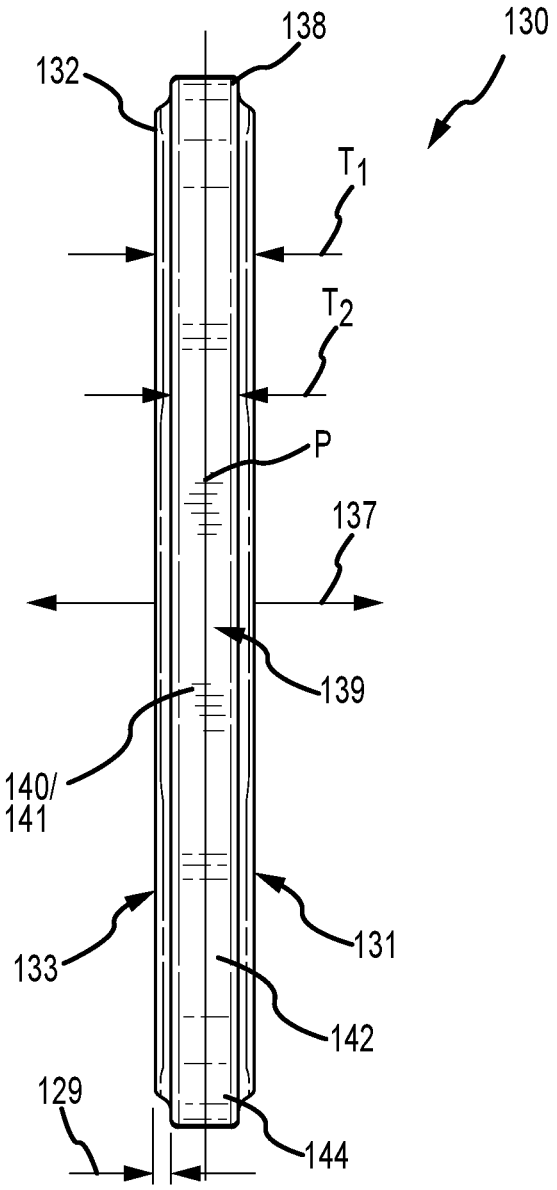
FIG. 4 is a side view of the nut shown in FIG. 3.

FIG. 3 is an end view of the nut 130 of the overflow system 108 (shown in FIG. 2). FIG. 4 is a side view of the nut 130. Referring concurrently to FIGS. 3 and 4 and as described above, the nut 130 is configured to secure the overflow conduit to the bathtub wall and couple the overflow cover over a portion of the conduit that extends into the bathtub. In the example, the nut 130 includes an inner mount 132 configured to engage with the outer surface of the overflow conduit. An inner radial surface 134 at least partially defines the inner mount 132 and has an inner perimeter that is substantially circular in shape and has a slightly larger diameter D than the body of the overflow conduit. The inner perimeter of the inner mount 132 corresponds in shape to the outer cross-sectional shape of the body of the overflow conduit. The inner surface 134 is threaded 135 so that the nut 130 can threadingly engage with the overflow conduit as shown in FIG. 2. The inner mount 132 also has an opposite outer radial surface 136 and a thickness $T_1$ that is defined in an axial direction 137 of the nut 130. The axial direction 137 of the nut 130 is used to define a front end 131 and a rear end 133 of the nut 130, and the ends 131, 133 are substantially similar so that either end of the nut 130 can face the overflow cover 116 as required or desired. In the example, the inner perimeter of the inner mount 132 is defined in a plane that is orthogonal to the axial direction 137 (e.g., the plane as illustrated in FIG. 3).

The nut 130 also includes an outer mount 138 configured to engage with at least a portion of the overflow cover 116 (shown in FIG. 2) such that the overflow cover is removably coupled to the nut 130. An outer surface 139 at least partially defines the outer mount 138 and has an outer perimeter that has a different shape from the inner mount 132 and as defined in a plane that is orthogonal to the axial direction 137 (e.g., the plane as illustrated in FIG. 3). For example, the outer mount 138 can have a perimeter that is substantially rectangular or square in shape as illustrated in FIG. 3, while the inner mount 132 is substantially circular in shape. In the example, the outer mount 138 has a different perimeter shape from the inner mount 132, and by forming the outer mount 138 as a different shape, it is easier to attach overflow covers having shapes that are different from substantially circular. For example, the cover, the nut, and the overflow conduit no longer need to have corresponding circular perimeter shapes. In the example, the outer perimeter of the outer mount 138 is substantially square, and the inner perimeter of the inner mount 132 is substantially circular.

As used herein, the term "substantially" when defining the shapes described herein means that the shape of the perimeter of the components have a general overall appearance of that shape and with the understanding that features may be present that deviate from the described shape. For example, substantially square can include corner features as illustrated in the outer mount 138 of the nut 130 that are not linear. In another example, substantially circular can include threaded features as illustrated in the inner mount 132 of the nut 130. In an aspect, the term "substantially" corresponds to shapes that have greater than 51% correspondence to the described shape. In another aspect, the term "substantially" corresponds to shapes that have greater than 75% correspondence to the described shape.

In the example, the outer surface 139 of the outer mount 138 and the inner surface 134 of the inner mount 132 are planar in the axial direction 137 of the nut 130, and thus, parallel to the axial direction 137. This configuration allows for either end 131, 133 of the nut 130 to face the overflow cover 116 as required or desired. As such, during installation of the nut 130 onto the overflow conduit, it does not matter which end 131, 133 of the nut 130 faces the bathtub wall since the nut 130 is symmetrical about a centerline plane P that is orthogonal to the axial direction 137.

The outer mount 138 is configured to engage with the overflow cover 116; however, not all sections of the outer mount 138 need to engage with the overflow cover. In the example, the outer mount 138 includes a plurality of engagement sections 141 that are configured to engage with the overflow cover and cooperate with the overflow cover to removably secure the cover to the nut 130. The remaining section of the outer mount 138 need not to engage with the overflow cover to secure the cover to the nut 130; however, in aspects, the remaining sections can engage with the overflow cover as required or desired.

In the example, the outer mount 138 has one or more linear portions 140 and one or more non-linear or curved portions 142. The linear portions 140 are formed from the engagement section 141 and are used to engage with the overflow cover as described herein. The outer surface 139 of the linear portions 140 are planar 143 in two orthogonal directions. For example, planar in the axial direction 137 and planar in an orthogonal tangential direction. In an aspect, there are four linear portions 140 with a curved portion 142 disposed on either side. The outer surface 139 of the curved portions 142 are planar in only the axial direction 137, while being curved inward 145 in the tangential direction and relative to the plane 143 of the linear portion 140. Additionally, the curved portions 142 are connected to each other at corners 144. The corners 144 enable for adjacent engagement sections 141 to be connected on the outer mount 138 and allow for a continuous outer surface 139. In an aspect, the corners 144 are at least partially curved relative to the engagement sections 141. In some examples, the corners 144 may provide additional support to the overflow cover 116 at its corners as required or desired. For example, at least a portion 147 of the outer surface 139 of the corner 144 may align with the outer surface 139 of the linear portions 140 so that it can engage with the overflow cover 116.

Each of the engagement sections 141 and linear portions 140 have a length $L_1$, and in the example, are positioned substantially tangential with respect to the inner mount 132. For example, each of the four engagement sections 141 have a point of tangency with respect to a center point CP of the inner mount 132 that are spaced approximately 90° from one another. As such, opposing pairs of the engagement sections 141 are substantially parallel to each other and substantially orthogonal to the other engagement sections 141. As used herein, "substantially tangential" means that the engagement section 141 and linear portions 140 is orthogonal to a diameter line of the inner mount 132 going through center point CP and within ±5° from orthogonal.

In the example, the length $L_1$ of each engagement section 141 can be about the same for each side of the nut 130. In an aspect, the length $L_1$ of each engagement section 141 is greater than one-third of the diameter D of the inner radial surface 134 of the inner mount 132. In another aspect, the length $L_1$ of each engagement section 141 is greater than one-half of the diameter D of the inner radial surface 134 of the inner mount 132. In other examples, the length $L_1$ of one or more engagement sections 141 can be different from (e.g., greater than or less than) the other engagement section 141 (e.g., for a substantially rectangular perimeter of the outer mount 138). The length $L_1$ of the engagement sections 141 is also greater than a length $L_2$ of the curved portion 142 and corners 144. In an aspect, the length $L_1$ of the engagement sections 141 is about twice the length $L_2$ of the curved portion 142 and corner 144.

The outer mount 138 may be unitarily formed with the inner mount 132, however, openings 148 may be formed between the outer mount 138 and the inner mount 132 proximate the corners 144. In the example, the openings 148 extend at least partially between the ends of the engagement sections 141 and the inner mount 132 and completely between the curved portions 142 and the inner mount 132. In another aspect, a portion of the curved portions 142 may be in contact with the inner mount 132 as required or desired. The curved portions 142 are concave 145 relative to the linear portions 140 so that the curved portions 142 do not necessarily engage with the overflow cover. The curved portions 142 can also act as finger holds to facilitate threading the nut 130 onto the overflow conduit during installation. The outer mount 138 may also have a thickness $T_2$ that is less than the thickness $T_1$ of the inner mount 132, and the outer mount 138 may be centered on the inner mount 132 about centerline plane P. As such, an undercut 129 is formed on each end 131, 133 between the inner mount 132 and the outer mount 138. The undercut 129 can be about half of the difference between the thickness $T_1$ of the inner mount 132 and the thickness $T_2$ of the outer mount 138. This configuration also allows for either end of the nut 130 to face the overflow cover 116 as required or desired and have the outer mount 138 spaced from the bathtub wall when the nut 130 is positioned directly against the wall so as to assist with engagement of the overflow cover.

The arrangement of the engagement sections 141 correspond to the shape of the overflow cover 116 and are configured to directly engage with the overflow cover 116 so that the cover can be secured to the overflow conduit of the overflow system. By forming the outer perimeter of the outer mount 138 in a different shape from the inner perimeter of the inner mount 132, the shape of the overflow cover can be different from the substantially cylindrical conduit so as to increase the number of customizable options for overflow system consumers. For example, the shape of the overflow cover 116 can take on a more square shape as illustrated in FIG. 2 for aesthetic purposes. Additionally, the nut 130 enables the overflow water flow through the overflow cover 116 to not be restricted.

Figure 6:
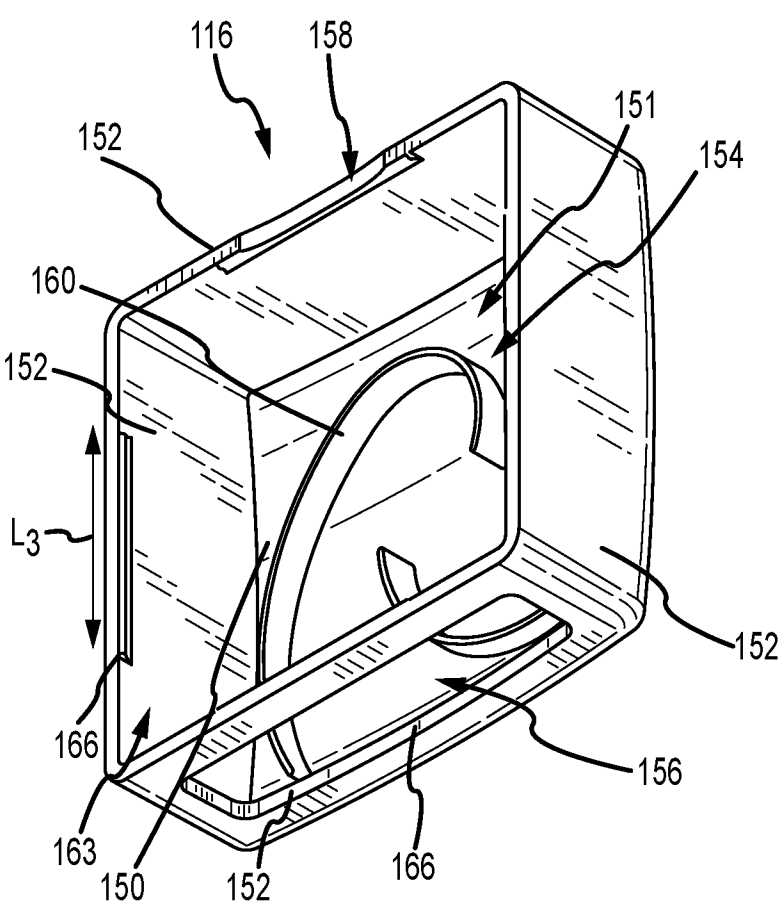
FIG. 6 is a rear perspective view of the overflow cover shown in FIG. 5.
Figure 5:
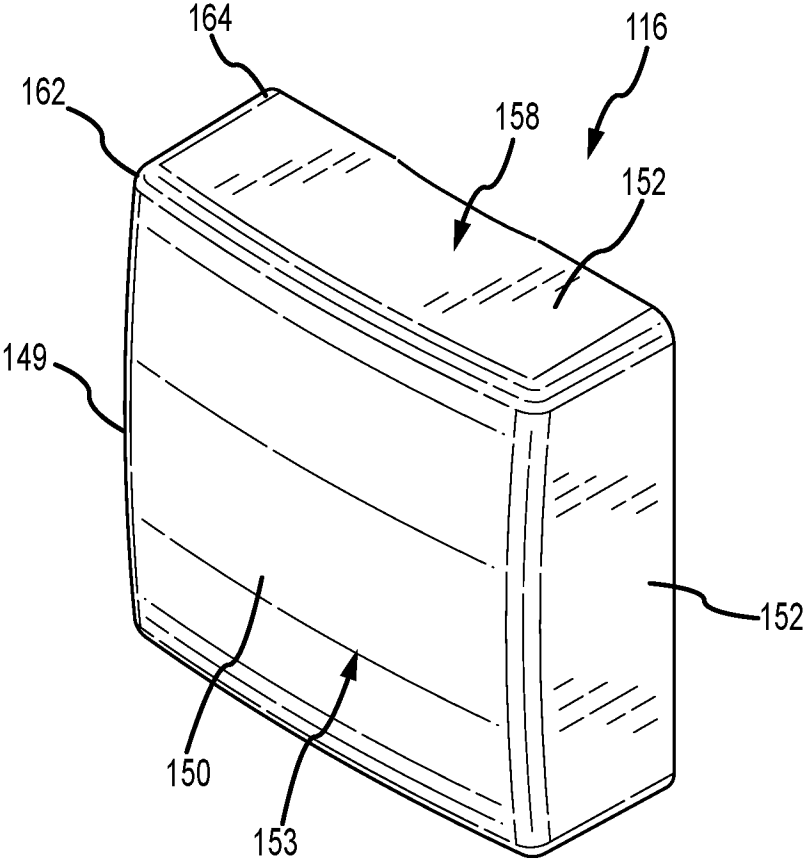
FIG. 5 is a front perspective view of an overflow cover of the overflow system shown in FIG. 2.

FIG. 5 is a front perspective view of the overflow cover 116 of the overflow system 108 (shown in FIG. 2). FIG. 6 is a rear perspective view of the overflow cover 116 shown. Referring concurrently to FIGS. 5 and 6, the overflow cover 116 is configured to couple to the nut 130 (shown in FIGS. 3 and 4) and has a body 149 with a front wall 150 that is substantially square in shape. The front wall 150 has an inner surface 151 and an outer surface 153 with the inner surface 151 that faces the overflow conduit. A plurality of linear side walls 152 extend from the inner surface 151 of the front wall 150 so that an inner cavity 154 is formed therein. The inner cavity 154 receives the nut 130 and a portion of the overflow conduit so as to cover the overflow port on the bathtub. One or more of the side walls 152 includes an opening 156 that allows water to flow into the inner cavity 154 and the overflow conduit. It should be appreciated that the opening 156 may include more than one opening, may be additionally or alternatively disposed on other side walls 152, may be formed at least partially on the front wall 150, or have any other shape and/or size as required or desired. Another opposing side wall 152 can include a vent recess 158 that provides pressure equalization and an increase in overflow fluid flow though the overflow system.

On the inner surface of the front wall 150, one or more fins 160 can extend therefrom. In some examples, the fins 160 can be used to condition the overflow fluid flow passing through the overflow cover 116 and into the overflow conduit. In other examples, the fins 160 can engage the front wall of the overflow conduit so that the inner surface 151 of the front wall 150 does not seal against the overflow conduit if the nut 130 is overtightened. In yet other examples, the front wall of the overflow conduit (shown in FIG. 2) may include one or more axial slots to reduce or prevent the front wall 150 of the cover 116 from sealing against the overflow conduit.

In the example, the side walls 152 have a first end 162 extending from the front wall 150 and an opposite second end 164 that is configured to be positioned adjacent the bathtub wall when installed. Each of the side walls 152 each have an inner surface 163 that at least partially defines the inner cavity 154 of the overflow cover 116. A lip 166 is included at each of the side walls 152 and extends from the inner surface 163 while being disposed at the second end 164 of the side walls 152 within the inner cavity 154. The lip 166 is configured to releasably engage with the engagement sections 141 of the outer mount 138 of the nut 130 (shown in FIGS. 3 and 4). As such, the lip 166 may have a length $L_3$ that is approximately equal to the length $L_1$ of the engagement sections 141. In other examples, the length $L_3$ of the lip 166 may be greater than, or less than, the length $L_1$ as required or desired. In the example, the length $L_3$ of the lip 166 does not extend all the way to the corners of the side walls 152. As such, the ends of the lip 166 are offset from the adjacent side walls 152. In an aspect, the lip 166 is generally linear and extends from the side wall 152 a distance that is about half of the difference between the thickness $T_1$ of the inner mount 132 and the thickness $T_2$ of the outer mount 138 of the nut 130 (shown in FIG. 4) so that the lip 166 can engage at least partially around the outer mount 138. This enables the lip 166 to wrap at least partially around the outer mount of the nut and fit within the undercut area.

The inner surfaces 163 of the side walls 152 define a perimeter with an inner cross-sectional shape. In an aspect, this inner cross-sectional shape is substantially square, and thus, different from the outer cross-sectional shape of the body 122 of the overflow conduit 114 (shown in FIG. 2). The outer surface 139 (shown in FIG. 3) of the engagement sections 141 correspond at least partially to the inner cross-sectional shape of the side walls 152 so that the nut 130 can engage with the inner surfaces 163 of the side walls 152. The curved portions 142 (shown in FIG. 3) of the outer mount 138 curve away from the inner surface 163 of the side walls 152 when the overflow cover 116 is coupled to the nut.

As illustrated in FIGS. 5 and 6, the side walls 152 correspond in shape to the front wall 150 of the overflow cover 116. In other examples, the side walls 152 may take a different shape from the front wall 150 as required or desired. In these other examples, the configuration of the front wall 150 can take on aesthetic shapes that make it difficult to form the side wall 152 and outer mount 138 engagement as described herein.

Figure 7:
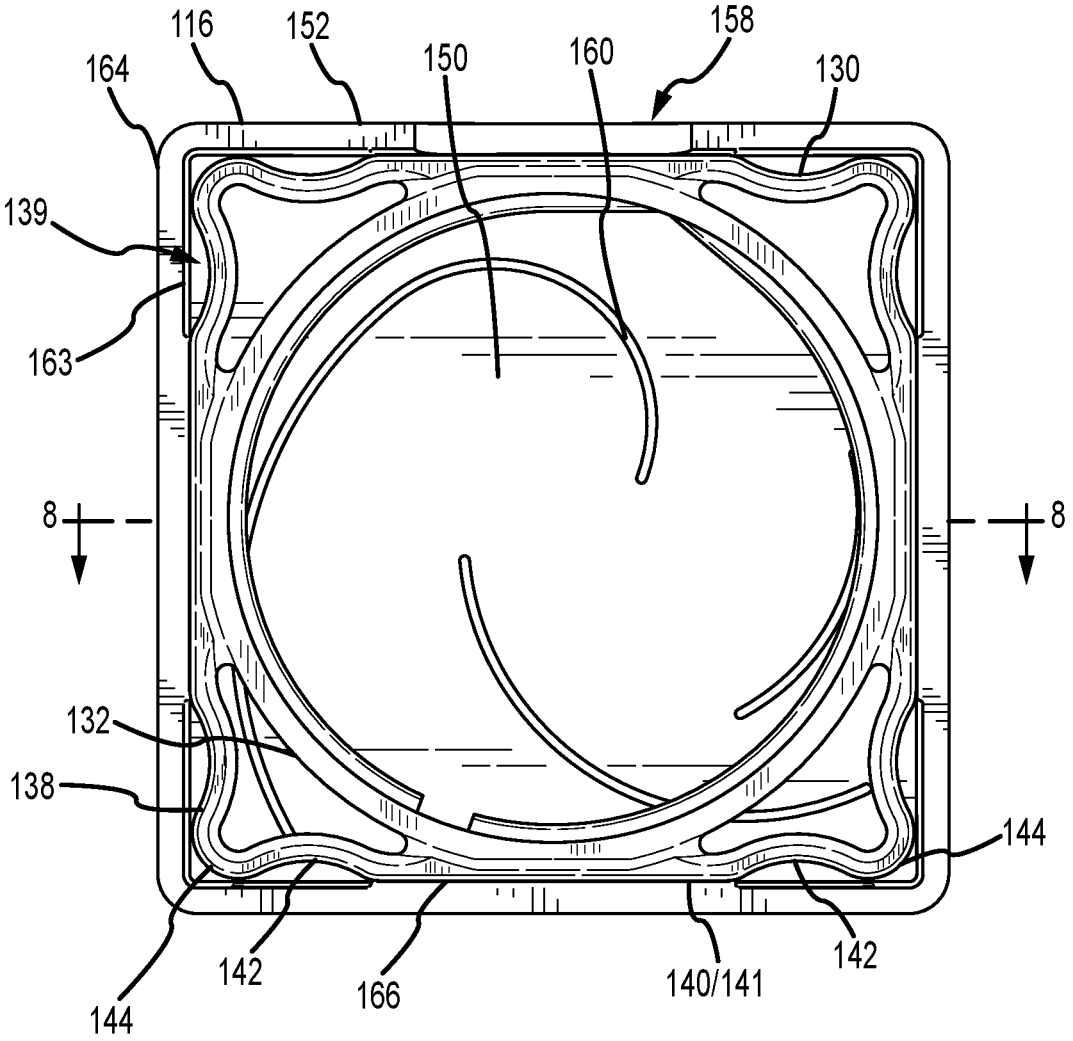
FIG. 7 is an end view of the nut shown in FIGS. 3 and 4 coupled to the overflow cover shown in FIGS. 5 and 6.
Figure 8:
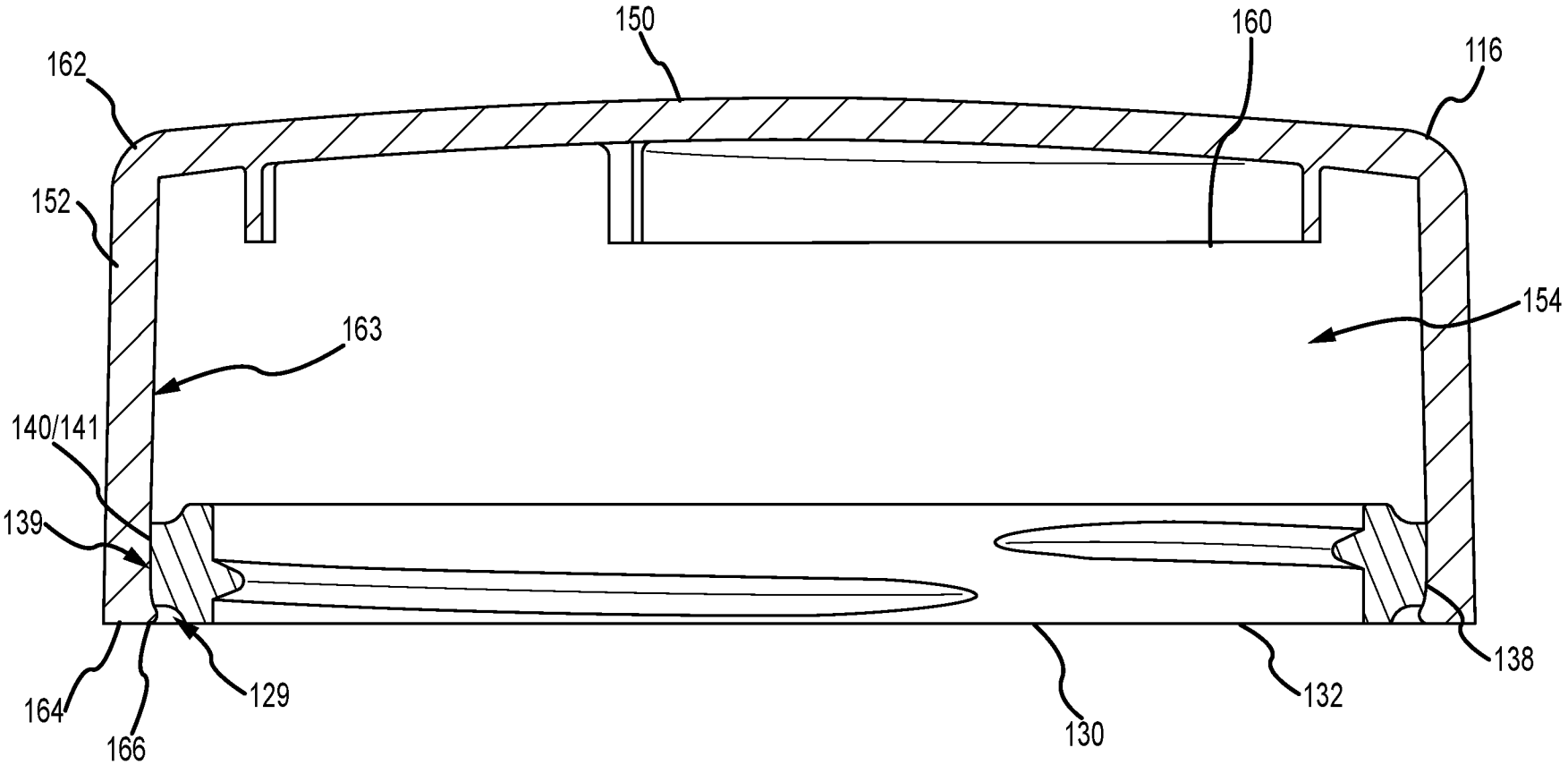
FIG. 8 is cross-sectional view of the nut coupled to the overflow cover taken along line 8-8 in FIG. 7.

FIG. 7 is an end view of the nut 130 coupled to the overflow cover 116. FIG. 8 is cross-sectional view taken along line 8-8 in FIG. 7. Referring concurrently to FIGS. 7 and 8, certain components are described above, and thus, are not necessarily described further. Additionally, the overflow conduit is not shown for clarity. To couple the overflow cover 116 to the overflow system and the nut 130, the lips 166 of the cover 116 snap around the outer mount 138 so that the outer surface 139 frictionally engages with the inner surface 163 of the side walls 152. As such, the nut 130 is engaged to both the lip 166 and the inner surface 163 of the side walls 152 to couple the cover 116 to the nut 130. This engagement secures the overflow cover 116 to the nut 130 without any external fasteners or connections, but also allows for the cover 116 to be removed as required or desired. For example, the cover 116 can be pulled away in the axial direction from the nut 130 to disengage the cover 116.

In the example, the thickness $T_2$ of the outer mount 138 is less than the thickness $T_1$ of the inner mount 132 (shown in FIG. 4), and as such, the lip 166 can engage with the engagement section 141 and allow the end 164 of the side walls 152 to align with the inner mount 132 against the bathtub wall. In an aspect, the lip 166 extends from the side wall 152 a distance that is about half of the difference between the thickness $T_1$ of the inner mount 132 and the thickness $T_2$ of the outer mount 138 of the nut 130. This enables the overflow cover 116 to be able to mount flush with the bathtub wall and at least partially within the undercut 129 of the nut 130. When the overflow cover 116 is coupled to the nut 130, the curved portion 142 of the outer mount 138 is spaced away from the side walls 152. In some examples, the corners 144 may contact the side walls 152 to assist with keeping the overflow cover 116 aligned on the overflow system.

Figure 9:
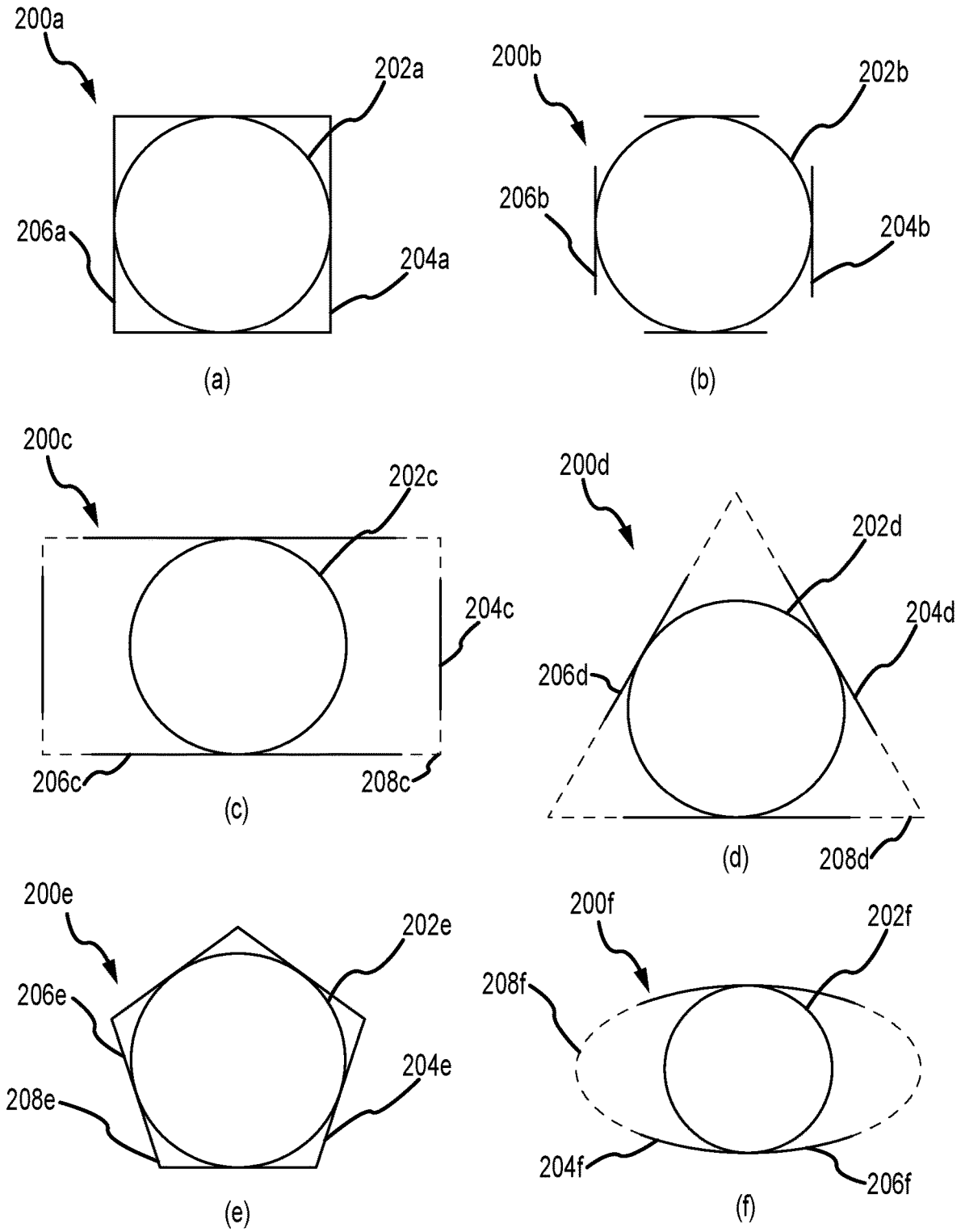
FIG. 9 schematically illustrates alternative examples of a nut for the overflow system shown in FIG. 2.

FIG. 9 schematically illustrates alternative examples of a nut for the overflow system 108 (shown in FIG. 2). As described above in reference to FIGS. 2-8, the overflow cover is square shaped, and thus, the outer mount of the nut is also substantially square shaped while the inner mount is substantially circular in shape. However, the outer mount of the nut and the cover engagement system can be applied to any other shapes as required or desired. This enables for the overflow cover to take on any aesthetic shape as required or desired. In example (a), a nut 200*a* may include a circular inner mount 202*a* and a substantially square outer mount 204*a* that is formed from all linear portions 206*a* coupled together and no curved portions. As such, the cover (not shown) can be square with lips that extend all the way to the corners. This configuration can increase connection strength at the corners.

In another example (b), a nut 200*b* may include a circular inner mount 202*b* and an outer mount 204*b* that is formed from a plurality of discrete linear portions 206*b* and no curved or corner portions. The linear portions 206*b* can have all have the same lengths or may have different lengths, for example, to accommodate a vent recess within the overflow cover. In this example, a square cover could again be used. In example (c), a nut 200*c* may include a circular inner mount 202*c* and a rectangular outer mount 204*c* with different lengths of linear portions 206*c*. The corners 208*c* of the outer mount 204*c* can be curved portions as described herein as required or desired. This example enables a rectangular cover to be used. In this example, one or more of the linear portions 206*c* may be spaced from the inner mount 202*c* as required or desired.

In yet another example (d), a nut 200*d* may include a circular inner mount 202*d* and a triangular outer mount 204*d* with a plurality of linear portions 206*d*. The corners 208*d* of the outer mount 204*d* can be curved portions as described herein. This example enables a triangular cover to the used. In example (e), a nut 200*e* may include a circular inner mount 202*e* and a pentagonal outer mount 204*e* with a plurality of linear portion 206*e*. The linear portions 206*e* may connect at corners 208*e*. In other examples, the corners 208*e* can be curved portions. This example enables a pentagon cover to be used.

In still another example (f), a nut 200*f* may include a circular inner mount 202*f* and an oval outer mount 204*f*. In this example, instead of a plurality of linear portions as described above, the outer mount 204*f* includes a plurality of non-linear portions 206*f*. However, the portions 206*f* have a different radius of curvature than the inner mount 202*f* so that the cover (not shown), which couples to the outer mount 204*f*, can have a different shape from the inner mount 202*f* (e.g., an oval). In this example, the non-linear portions 206*f* have a greater radius of curvature than the inner mount 202*f*. By matching the portions 206*f* to the shape of the cover and the outer mount 204*f* having a different shape from the inner mount 202*f*, the cover and the nut can take on any shape as require or desired, as long as the portions 206*f* have enough length so as to fictionally engage the cover. The portions 206*f* can be coupled together with corners 208*f* as required or desired.

It is to be understood that any number of the features of the different examples described herein may be combined into one single example and alternate examples having fewer than or more than all of the features herein described are possible. Additionally, the shape of the overflow cover can be any other shape as required or desired. For example, diamond, hexagon, octagon, parallelogram, trapezoid, etc. Additionally or alternatively, the shape of the overflow cover can take any non-geometric shape along as there are lips that are formed that can engage with a linear portion on the nut. As such, the nut described herein can enable for custom shaped covers as required or desired.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An overflow system for concealing an overflow conduit of a bathtub, the overflow system comprising:

a nut comprising:

an inner mount configured to secure to the overflow conduit, wherein a cross-sectional shape of the inner mount is substantially circular in shape; and an outer mount comprising a plurality of engagement sections that extend substantially tangential to the inner mount, wherein the inner mount has a thickness that is greater than a thickness of the outer mount, and the outer mount is centered on and integral with the inner mount; and an overflow cover configured to couple to the nut, wherein a cross-sectional shape of the overflow cover is substantially square and comprises:

a front wall; and a plurality of side walls, each having a first end extending from the front wall and an opposite second end, wherein the second end comprises a lip configured to engage with a respective engagement section of the plurality of engagement sections when the overflow cover is coupled to the nut, and wherein the plurality of side walls are configured to radially engage the outer mount when the overflow cover is coupled to the nut.

2. The overflow system of claim 1, wherein a length of the lip is approximately equal to a length of the respective engagement section.

3. The overflow system of claim 1, wherein each of the plurality of engagement sections is a linear portion and the outer mount further comprises curved portions disposed at both ends of each linear portion.

4. The overflow system of claim 3, wherein when the overflow cover is coupled to the nut the curved portions curve away from the respective side wall of the plurality of side walls.

5. The overflow system of claim 3, wherein adjacent curved portions are coupled together at a corner.

6. The overflow system of claim 1, wherein each of the plurality of engagement sections has a point of tangency with respect to the inner mount that are spaced approximately 90° from each other.

7. The overflow system of claim 1, wherein each of the plurality of engagement sections has approximately the same length.

8. An overflow system for concealing an overflow conduit of a bathtub, the overflow system comprising:

a nut comprising:

an inner radial surface at least partially defining an inner mount configured to secure to the overflow conduit; and an outer surface at least partially defining an outer mount, the outer surface being planer in an axial direction of the nut and comprising a plurality of engagement sections that extend tangential to the inner mount, wherein a corner extends between adjacent engagement sections of the plurality of engagement sections and the corner is spaced apart from the inner mount via an opening; and an overflow cover having a body with an outer surface and an inner surface, the inner surface defines an inner cavity shaped and sized to receive the nut and at least a portion of the overflow conduit, wherein when the overflow cover is coupled to the nut, the plurality of engagement sections of the nut engage with the inner surface of the overflow cover to removably couple the overflow cover to the nut.

9. The overflow system of claim 8, wherein the inner surface of the overflow cover comprises one or more lips configured to engage with a respective engagement section of the plurality of engagement sections.

10. The overflow system of claim 9, wherein the one or more lips and the plurality of engagement sections are linear.

11. The overflow system of claim 8, wherein each of the plurality of engagement sections has a length that is greater than one-third of a diameter of the inner radial surface.

12. The overflow system of claim 8, wherein the inner mount has a thickness that is greater than a thickness of the outer mount, and the outer mount is centered on and integral with the inner mount.

13. An overflow system for a bathtub comprising:

an overflow conduit configured to secure to the bathtub at an overflow port and at least partially extend into the bathtub, wherein the overflow conduit has an outer surface that defines a first perimeter with an outer cross-sectional shape;

an overflow cover configured to at least partially cover the overflow conduit within the bathtub, the overflow cover comprising:

a front wall having an inner surface and an outer surface, wherein when the overflow cover covers the overflow conduit the inner surface faces the overflow conduit; and a plurality of side walls each having a first end and an opposite second end, the first end extending from the inner surface of the front wall and the second end when the overflow cover covers the overflow conduit is positioned adjacent the bathtub, wherein the plurality of side walls each also has an inner surface that defines a second perimeter with an inner cross-sectional shape, the inner cross-sectional shape being different from the outer cross-sectional shape of the overflow conduit; and a nut configured to secure to the overflow conduit and couple the overflow cover to the overflow conduit, the nut comprising:

an inner mount configured to secure to the outer surface of the overflow conduit; and an outer mount configured to engage with at least a portion of the inner surfaces of the plurality of side walls of the overflow cover such that the overflow cover is removably coupled to the nut.

14. The overflow system of claim 13, wherein the outer mount of the nut comprises a plurality of engagement sections having an outer surface being planer in an axial direction of the nut, and wherein the outer surface of the plurality of engagement sections correspond at least partially to the inner cross-sectional shape of the plurality of side walls of the overflow cover.

15. The overflow system of claim 14, wherein each of the plurality of engagement sections has a length that extends substantially tangential to the inner mount.

16. The overflow system of claim 15, wherein the outer mount of the nut comprises one or more corners that connect adjacent engagement sections of the plurality of engagement sections.

17. The overflow system of claim 16, wherein the one or more corners are at least partially curved relative to the length of each of the plurality of engagement sections.

18. The overflow system of claim 13, wherein the inner mount has a thickness that is greater than a thickness of the outer mount, and the outer mount is centered on and integral with the inner mount.

19. The overflow system of claim 13, wherein at least a portion of one or more of the second end of the plurality of side walls of the overflow cover include an inwardly extending lip that is configured to engage with a respective engagement section of the plurality of engagement sections of the nut.

* * * * *